US008929557B2

(12) United States Patent
Nakagawa et al.

(10) Patent No.: US 8,929,557 B2
(45) Date of Patent: Jan. 6, 2015

(54) SOUND IMAGE CONTROL DEVICE AND SOUND IMAGE CONTROL METHOD

(75) Inventors: Toru Nakagawa, Chiba (JP); Yuuji Yamada, Tokyo (JP)

(73) Assignee: Sony Corporation, Tokyo (JP)

( * ) Notice: Subject to any disclaimer, the term of this patent is extended or adjusted under 35 U.S.C. 154(b) by 340 days.

(21) Appl. No.: 13/367,841

(22) Filed: Feb. 7, 2012

(65) Prior Publication Data

US 2012/0224700 A1 Sep. 6, 2012

(30) Foreign Application Priority Data

Mar. 2, 2011 (JP) ..... 2011-044710

(51) Int. Cl.
*H04R 5/00* (2006.01)
*H04S 1/00* (2006.01)
*H04S 7/00* (2006.01)

(52) U.S. Cl.
CPC .. *H04S 1/005* (2013.01); *H04S 7/40* (2013.01)
USPC ..... 381/17; 381/104

(58) Field of Classification Search
CPC ..... H04S 1/002; H04S 1/005; H04S 7/305; H04S 7/306
USPC ..... 381/1, 17, 18, 61, 63, 104, 309, 310
See application file for complete search history.

(56) References Cited

U.S. PATENT DOCUMENTS

| | | | | |
|---|---|---|---|---|
| 5,065,432 | A * | 11/1991 | Sasaki et al. | 381/61 |
| 5,555,306 | A * | 9/1996 | Gerzon | 381/63 |
| 5,684,881 | A * | 11/1997 | Serikawa et al. | 381/86 |
| 5,742,688 | A * | 4/1998 | Ogawa et al. | 381/17 |
| 5,850,454 | A * | 12/1998 | Hawks | 381/1 |
| 7,010,370 | B1 * | 3/2006 | Riegelsberger | 700/94 |
| 2006/0023889 | A1 * | 2/2006 | Suzaki et al. | 381/17 |
| 2010/0310155 | A1 * | 12/2010 | Newton et al. | 382/154 |
| 2011/0274278 | A1 * | 11/2011 | Kim | 381/17 |
| 2013/0010969 | A1 * | 1/2013 | Cho et al. | 381/17 |

FOREIGN PATENT DOCUMENTS

| | | |
|---|---|---|
| JP | 8-205925 | 8/1996 |
| JP | 8-9498 | 1/2006 |

* cited by examiner

*Primary Examiner* — Vivian Chin
*Assistant Examiner* — Karl Mihm
(74) *Attorney, Agent, or Firm* — Sherr & Jiang, PLLC

(57) ABSTRACT

A sound-image control device includes a sound-image controller that processes a left sound signal and a right sound signal to localize a sound image at a predetermined position. The sound-image controller performs control for enhancing a sense of depth to a sound image originally included in an input sound signal.

12 Claims, 14 Drawing Sheets

SOUND IMAGE CONTROL DEVICE AND SOUND IMAGE CONTROL METHOD

BACKGROUND

The present technology relates to sound-image control devices and sound-image control methods. More specifically, the present technology relates to a sound-image control apparatus and a sound-image control device which are applicable to a headphone apparatus, a speaker apparatus, and so on for reproducing 2-channel stereo sound signals.

For example, Japanese Unexamined Patent Application Publication No. 08-009498 discloses a technology for a 2-channel stereo sound reproducing apparatus placed on the head of a listener. In the technology, in order to realize virtual reality, a sound image is controlled according to the position of the listener relative to one or more sound sources.

For example, Japanese Unexamined Patent Application Publication No. 08-205295 discloses a technology in which the amount of horizontal displacement between left video and right video in three-dimensional video is detected so as to allow real-time acquirement of perspective data and the amount of amplification and the amount of delay of a sound signal are varied in accordance with the perspective data, thereby achieving creation of a sound image that matches the three-dimensional video.

SUMMARY

The technology disclosed in Japanese Unexamined Patent Application Publication No. 08-009498 is aimed to control the sound image in accordance with the position of the listener relative to the sound source(s). The technology disclosed in Japanese Unexamined Patent Application Publication No. 08-205295 is aimed to control the sound image in accordance with the perspective data obtained based on the three-dimensional video data. Those technologies, however, are not adapted to control the sense of distance to the sound image, included in the original sound signal, so that the sense of depth is further enhanced.

Accordingly, it is desirable to control the sense of distance to the sound image, included in the original sound signal, so that the sense of depth is further enhanced.

An embodiment of the present technology provides a sound-image control device including a sound-image controller that processes a left sound signal and a right sound signal to localize a sound image at a predetermined position. The sound-image controller performs control for enhancing a sense of depth to a sound image originally included in an input sound signal.

According to an embodiment of the present technology, the sound-image control device processes a left sound signal and a right sound signal so as to localize the sound image at a predetermined position. The sound-image controller performs control for enhancing the sense of depth to the sound image originally included in an input sound signal.

According to an embodiment of the present technology, the sound-image controller may include: a direct-sound filter that extracts a direct-sound signal from the input sound signal; an indirect-sound filter that extracts an indirect-sound signal from the input sound signal; a delay unit that delays the indirect-sound signal extracted by the indirect-sound filter; a first amplifier that amplifies the direct-sound signal extracted by the direct-sound filter; a second amplifier that amplifies the indirect-sound signal delayed by the delay unit; a first sound-pressure controller that controls a signal amplification amount for the first amplifier, in accordance with the level of the input sound signal; and an adder that adds the direct-sound signal amplified by the first amplifier and the indirect-sound signal amplified by the second amplifier to obtain an output sound signal.

In this example, the first sound-pressure controller may increase at least the signal amplification amount for the first signal amplifier in a level range that is higher than a first level of the input sound signal or may reduce at least the signal amplification amount for the first amplifier in a level range that is lower than a second level that is lower than the first level of the input sound signal.

In the sound-image control device, the sound-image controller may further include a second sound-pressure controller that controls, in accordance with the level of the input sound signal, the signal amplification amount for the second amplifier so that the signal amplification amount has a reverse characteristic of a characteristic of the signal amplification amount for the first amplifier, the signal amplification amount for the first amplifier controller being controlled by the first sound-pressure controller.

In the sound-image control device, the sound-image controller may further include a delay controller that controls a signal delay amount for the delay unit in accordance with the level of the input sound signal. The delay controller may reduce at least the signal amplification amount for the delay unit in a level range that is higher than a first level of the input sound signal or may increase at least the signal delay amount for the delay unit in a level range that is lower than a second level that is lower than the first level of the input sound signal.

According to an embodiment of the present technology, the sound-image control device may further include a switching operation unit that switches a degree of enhancement of the sense of depth to the sound image originally included in the input sound signal, the enhancement being performed by the sound-image controller. For example, the conceivable listener's sense of distance differs depending upon, for example, whether the equipment used is portable equipment, such as portable game equipment, or a large-size television receiver. Since the switching operation unit for switching the degree of enhancement of the sense of depth is provided, it is possible to enhance the sense of distance suitable for the equipment used.

In this case, the sound-image controller may include: a direct-sound filter that extracts a direct-sound signal from the input sound signal; an indirect-sound filter that extracts an indirect-sound signal from the input sound signal; a delay unit that delays the indirect-sound signal extracted by the indirect-sound filter; a first amplifier that amplifies the direct-sound signal extracted by the direct-sound filter; a second amplifier that amplifies the indirect-sound signal delayed by the delay unit; a first sound-pressure controller that controls a signal amplification amount for the first amplifier, in accordance with the level of the input sound signal; a second sound-pressure controller that controls, in accordance with the level of the input sound signal, the signal amplification amount for the second amplifier so that the signal amplification amount has a reverse characteristic of a characteristic of the signal amplification amount for the first amplifier, the signal amplification amount for the first amplifier being controlled by the first sound-pressure controller; a delay controller that controls a signal delay amount for the delay unit in accordance with the level of the input sound signal; and an adder that adds the direct-sound signal amplified by the first amplifier and the indirect-sound signal amplified by the second amplifier to obtain an output sound signal. The switching operation unit may switch control operations of the first sound-pressure controller, the second sound-pressure controller, and the delay controller.

According to an embodiment of the present technology, the sound-image controller may perform control for enhancing the sense of depth to the sound image originally included in the input sound signal, on the basis of a level of the input sound signal and information of parallax between left-eye video and right-eye video included in three-dimensional video corresponding to the input sound signal. Since the enhancement control is performed on the basis of the information of the parallax, it is possible to achieve representation of a sound image that matches the three-dimensional video and that gives more enhanced sense of depth.

In this case, the sound-image controller may include: a direct-sound filter that extracts a direct-sound signal from the input sound signal; an indirect-sound filter that extracts an indirect-sound signal from the input sound signal; a delay unit that delays the indirect-sound signal extracted by the indirect-sound filter; a first amplifier that amplifies the direct-sound signal extracted by the direct-sound filter; a second amplifier that amplifies the indirect-sound signal delayed by the delay unit; a first sound-pressure controller that controls a signal amplification amount for the first amplifier, in accordance with the level of the input sound signal and the information of the parallax; and an adder that adds the direct-sound signal amplified by the first amplifier and the indirect-sound signal amplified by the second amplifier to obtain an output sound signal.

The first sound-pressure controller may increase, by an amount corresponding to a value of the parallax, at least the signal amplification amount for the first signal amplifier in a level range that is higher than a first level of the input sound signal or may reduce, by an amount corresponding to the value of the parallax, at least the signal amplification amount for the first amplifier in a level range that is lower than a second level that is lower than the first level of the input sound signal.

The sound-image controller may further include a second sound-pressure controller that controls, in accordance with the level of the input sound signal and the information of the parallax, the signal amplification amount for the second amplifier so that the signal amplification amount has a reverse characteristic of a characteristic of the signal amplification amount for the first amplifier, the signal amplification amount for the first amplifier being controlled by the first sound-pressure controller.

The sound-image controller may further include a delay controller that controls a signal delay amount for the delay unit in accordance with the level of the input sound signal and the information of the parallax. The delay controller may reduce, by an amount corresponding to a value of the parallax, at least the signal delay amount for the delay unit in a level range that is higher than a first level of the input sound signal or may increase, by an amount corresponding to the value of the parallax, at least the signal delay amount for the delay unit in a level range that is lower than a second level that is lower than the first level of the input sound signal.

According to an embodiment of the present technology, the sound-image control device may further include a crosstalk cancellation corrector at an output side of the sound-image controller. In this case, since the crosstalk cancellation corrector is provided, the present technology is also applicable to a speaker apparatus for reproducing 2-channel stereo sound signals, similarly to a headphone apparatus.

The present technology can control the sense of distance to the sound image, included in the original sound signal, so that the sense of depth is further enhanced.

DETAILED DESCRIPTION OF EMBODIMENTS

Modes (herein referred to as "embodiments") for implementing the present disclosure will be described below. A description below is given in the following sequence:

1. First Embodiment
2. Second Embodiment
3. Third Embodiment
4. Modifications

1. First Embodiment

[Example of Configuration of Sound Image Control Device]

Figure 1:
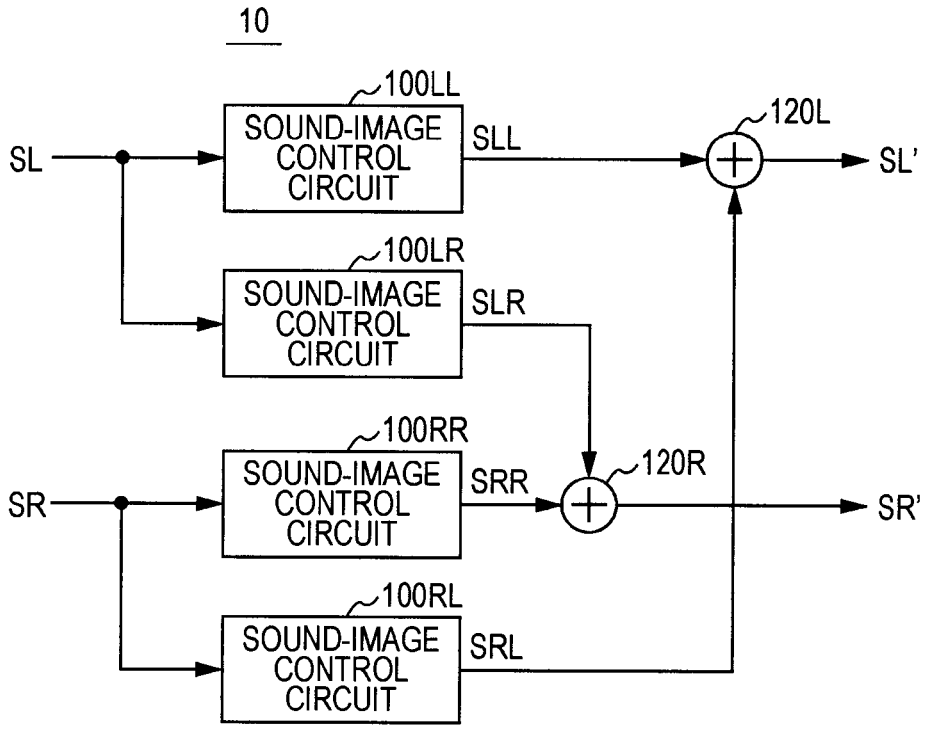
FIG. 1 is a block diagram illustrating an example of the configuration of a sound-image control device according to a first embodiment of the present technology.

FIG. 1 illustrates an example of the configuration of a sound-image control device 10 according to a first embodiment. A description will be given of an example in which the sound-image control device 10 is applied to a headphone apparatus for reproducing 2-channel stereo sound signals. The sound-image control device 10 includes sound-image control circuits 100LL, 100LR, 100RR, and 100RL, and adders 120L and 120R.

Figure 2:
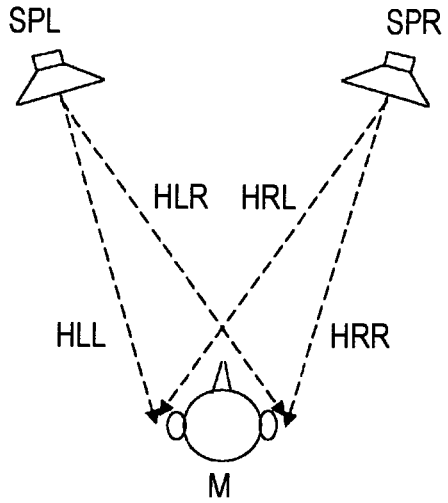
FIG. 2 illustrates a propagation state of sound reproduced by speakers.

FIG. 2 illustrates a propagation state of sound reproduced by speakers. Sound reproduced by a left speaker SPL and sound reproduced by a right speaker SPR have characteristics to which reflection at the ears of a listener M, diffraction, and reflection of a room are added. A transmission characteristic HLL of sound to the left ear and a transmission characteristic HLR of sound to the right ear are added to the sound reproduced by the left speaker SPL and the resulting sound reaches both ears of the listener M. A transmission characteristic HRR of sound to the right ear and a transmission characteristic HRL of sound to the left ear are added to the sound reproduced by the right speaker SPR and the resulting sound reaches both ears of the listener M.

Referring back to FIG. 1, the sound-image control circuit 100LL has a filter having the transmission characteristic HLL of sound reaching from the left speaker SPL to the left ear of the listener M. The sound-image control circuit 100LL performs filter processing on an input left sound signal SL to generate a left sound signal SLL to be input to the left ear of the listener M. The sound-image control circuit 100LR has a filter having the transmission characteristic HLR of sound reaching from the left speaker SPL to the right ear of the listener M. The sound-image control circuit 100LR performs filter processing on the input left sound signal SL to generate a left sound signal SLR to be input to the right ear of the listener M.

The sound-image control circuit 100RR has a filter having the transmission characteristic HRR of sound reaching from the right speaker SPR to the right ear of the listener M. The sound-image control circuit 100RR performs filter processing on an input right sound signal SR to generate a right sound signal SRR to be input to the right ear of the listener M. The sound-image control circuit 100RL has a filter having the transmission characteristic HRL of sound reaching from the left speaker SPR to the left ear of the listener M. The sound-image control circuit 100RL performs filter processing on the input right sound signal SR to generate a right sound signal SRL to be input to the left ear of the listener M.

In addition to the filter processing described above, each of the sound-image control circuits 100LL, 100LR, 100RR, and 100RL performs sound-image control processing in accordance with the level of the input sound signal. The sound-image control processing involves control of an amount of signal amplification (which may herein be referred to as a "signal amplification amount") of a direct-sound signal, control of a signal amplification amount of an indirect-sound signal, control of an amount of signal delay (which may herein be referred to as a "signal delay amount") of an indirect-sound signal, and so on.

The adder 120L adds the right sound signal SRL, generated by the sound-image control circuit 100RL, to the left sound signal SLL, generated by the sound-image control circuit 100LL, to obtain a left sound signal SL' to be supplied to a left speaker of a headphone (not illustrated). The adder 120R adds the left sound signal SLR, generated by the sound-image control circuit 100LR, to the right sound signal SRR, generated by the sound-image control circuit 100RR, to obtain a right sound signal SR' to be supplied to a right speaker of the headphone (not illustrated).

An operation of the sound-image control device 10 illustrated in FIG. 1 will be briefly described next. The left sound signal SL is supplied to the sound-image control circuit 100LL and the sound-image control circuit 100LR. The sound-image control circuit 100LL performs filter processing on the left sound signal SL and further performs sound-image control processing on the basis of the level of the input sound signal to thereby generate a left sound signal SLL to be input to the left ear of the listener M. The sound-image control circuit 100LR performs filter processing on the left sound signal SL and further performs sound-image control processing on the basis of the level of the input sound signal to thereby generate a left sound signal SLR to be input to the right ear of the listener M.

The right sound signal SR is supplied to the sound-image control circuit 100RR and the sound-image control circuit 100RL. The sound-image control circuit 100RR performs filter processing on the right sound signal SR and further performs sound-image control processing on the basis of the level of the input sound signal to thereby generate a right sound signal SRR to be input to the right ear of the listener M. The sound-image control circuit 100RL performs filter processing on the right sound signal SR and further performs sound-image control processing on the basis of the level of the input sound signal to thereby generate a right sound signal SRL to be input to the left ear of the listener M.

The left sound signal SLL generated by the sound-image control circuit 100LL and the right sound signal SRL generated by the sound-image control circuit 100RL are supplied to the adder 120L. The adder 120L adds the right sound signal SRL to the left sound signal SLL to obtain a left sound signal SL' to be supplied to the left speaker of the headphone. The right sound signal SRR generated by the sound-image control circuit 100RR and the left sound signal SLR generated by the sound-image control circuit 100LR are supplied to the adder 120R. The adder 120R adds the left sound signal SLR to the right sound signal SRR to obtain a right sound signal SR' to be supplied to the right speaker of the headphone.

Figure 3:
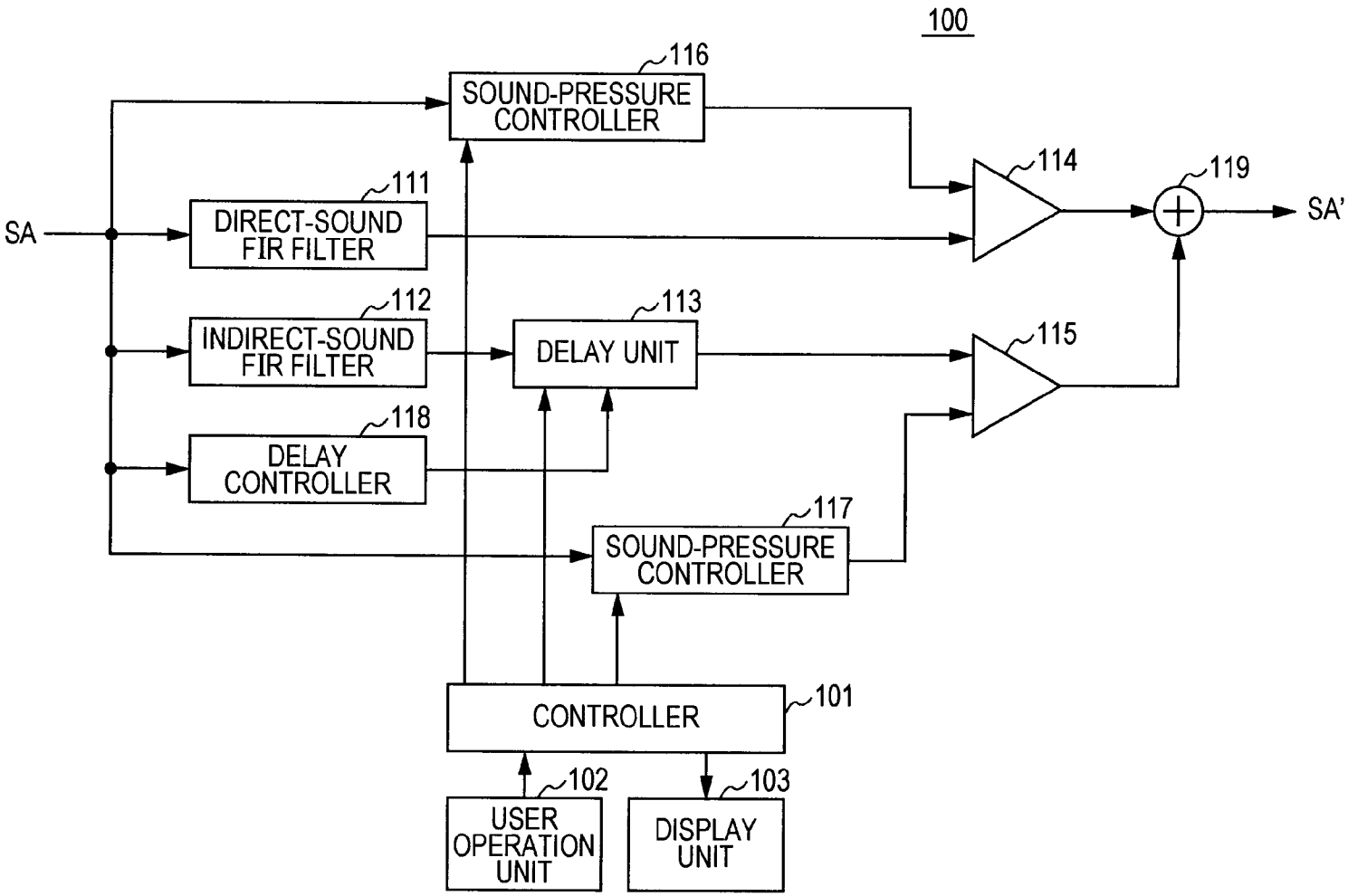
FIG. 3 is a block diagram illustrating an example of the configuration of a sound-image control circuit included in the sound-image control device.

FIG. 3 illustrates an example of the configuration of a sound-image control circuit 100 (which corresponds to the sound-image control circuits 100LL, 100LR, 100RR, and 100RL). The sound-image control circuit 100 has a controller 101, a user operation unit 102, and a display unit 103. The sound-image control circuit 100 further has a direct-sound FIR (finite impulse response) filter 111 and an indirect-sound FIR filter 112. The sound-image control circuit 100 further has a delay unit 113, amplifiers 114 and 115, sound-pressure controllers 116 and 117, a delay controller 118, and an adder 119.

The controller 101 includes, for example, a microcomputer, to control operations of the individual elements in the sound-image control circuit 100. The user operation unit 102 and the display unit 103 provide user interfaces and are connected to the controller 101.

Figure 4:
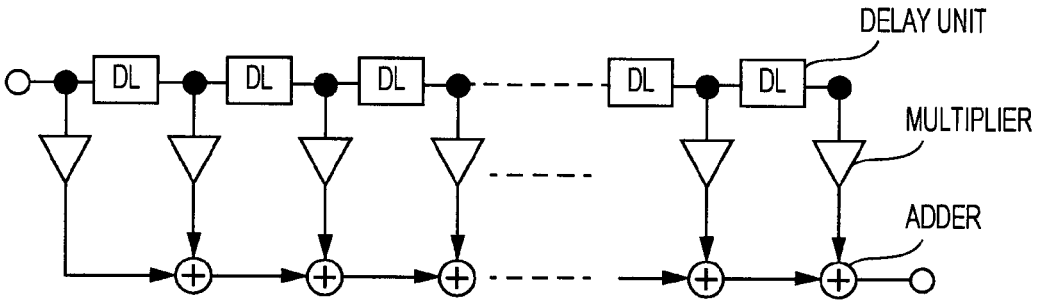
FIG. 4 illustrates an example of the configuration of a direct-sound FIR filter and an indirect-sound FIR filter included in the sound-image control circuit.

The direct-sound FIR filter 111 serves as a filter for generating a direct-sound signal from an input sound signal SA. The indirect-sound FIR filter 112 serves as a filter for generating an indirect-sound signal from the input sound signal SA. FIG. 4 illustrates an example of the configuration of each of the direct-sound FIR filter 111 and the indirect-sound FIR filter 112. As illustrated in FIG. 4, the FIR filter includes arithmetic-operation units, such as multipliers, delay units, and adders. The arithmetic operation units are provided so as to correspond to the number of samples of coefficient data.

Figure 5:
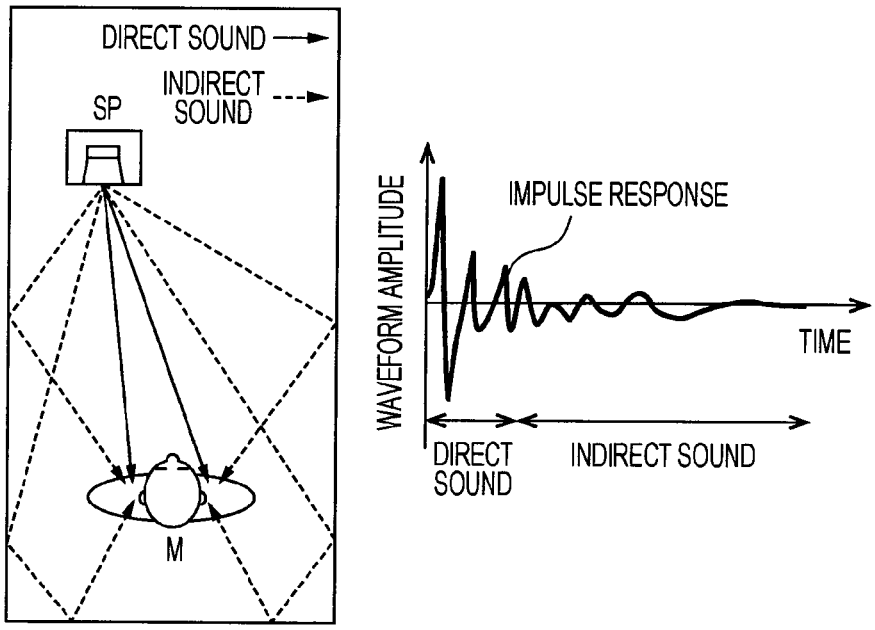
FIG. 5 illustrates one example of a method for measuring direct-sound coefficient data for convolution performed by the direct-sound FIR filter and indirect-sound coefficient data for convolution performed by the indirect-sound FIR filter.

Now, one example of a method for measuring direct-sound coefficient data for convolution performed by the direct-sound FIR filter 111 and indirect-sound coefficient data for convolution performed by the indirect-sound FIR filter 112 will be described with reference to FIG. 5. In this measurement method, an impulse response from the speaker SP to microphones placed at the external-ear canal entrances at the auricles of a listener M in a viewing/listening room where reverberation occurs is obtained. The impulse response is divided into initial data and subsequent data, and the initial data and the subsequent data are referred to as "direct-sound coefficient data" and "indirect-data coefficient data", respectively.

Figure 6A:
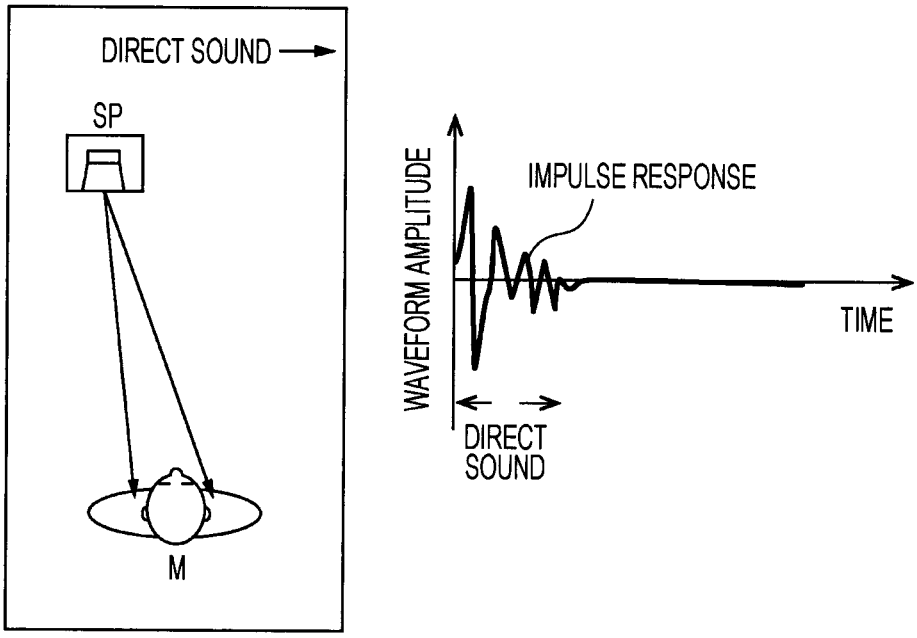
FIGS. 6A and 6B illustrate another example of a method for measuring the direct-sound coefficient data for convolution performed by the direct-sound FIR filter and the indirect-sound coefficient data for convolution performed by the indirect-sound FIR filter.
Figure 6B:
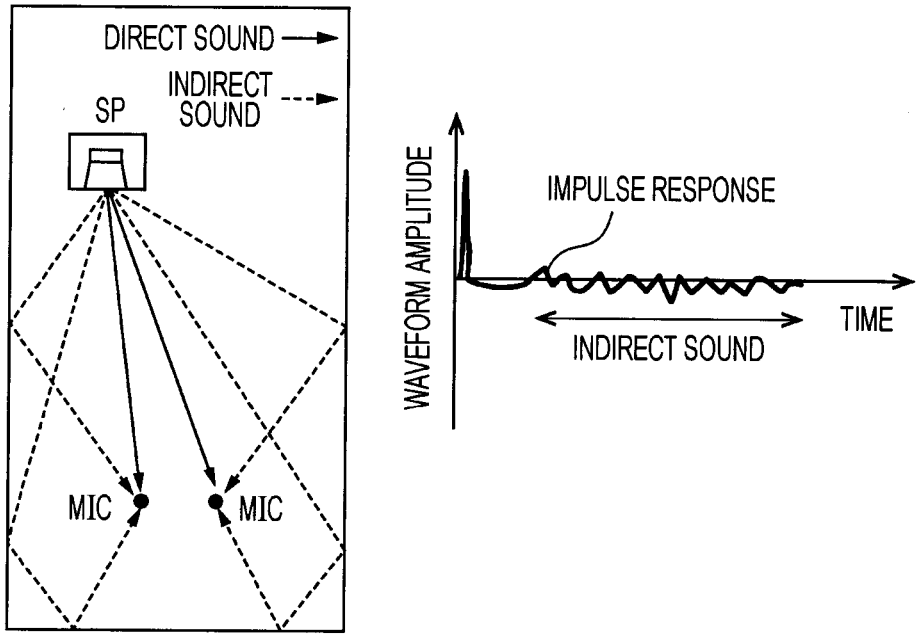

Next, another example of a method for measuring the direct-sound coefficient data for convolution performed by the direct-sound FIR filter 111 and the indirect-sound coefficient data for convolution performed by the indirect-sound FIR filter 112 will be described with reference to FIGS. 6A and 6B. In this measurement method, as illustrated in FIG. 6A, an impulse response from the speaker SP to microphones placed at the external-ear canal entrances at the auricles of the listener M in an anechoic room where no reverberation occurs is obtained. This impulse response is used as the direct-sound coefficient data. In the measurement method, as illustrated in FIG. 6B, an impulse response from the speaker SP to microphones MIC where the listening/viewing positions are placed in a viewing/listening room where reverberation occurs is obtained. This impulse response is used as the indirect-sound coefficient data.

Referring back to FIG. 3, a sound-image control parameter indicative of a signal delay amount is supplied from the delay controller 118 to the delay unit 113. On the basis of the sound-image control parameter, the delay unit 113 delays an indirect-sound signal generated by the indirect-sound FIR filter 112. A sound-image control parameter indicative of a signal amplification amount is supplied from the sound-pressure controller 116 to the amplifier 114. On the basis of the sound-image control parameter, the amplifier 114 amplifies a direct-sound signal generated by the direct-sound FIR filter 111. On the basis of a sound-image control parameter supplied from the sound-pressure controller 117 and indicative of a signal amplification amount, the amplifier 115 amplifies the indirect-sound signal delayed by the delay unit 113. The adder 119 adds the direct-sound signal, amplified by the amplifier 114, and the indirect-sound signal, amplified by the amplifier 115, to obtain an output sound signal SA'.

Figure 7:
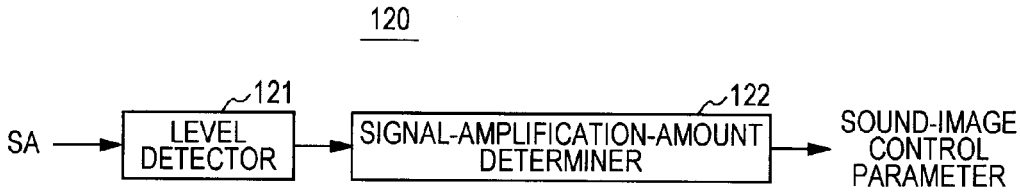
FIG. 7 is a block diagram illustrating an example of the configuration of a sound-pressure controller included in the sound-image control circuit.

FIG. 7 illustrates an example of the configuration of a sound-pressure controller 120 (which corresponds to the sound-pressure controller 116 and the sound-pressure controller 117). The sound-pressure controller 120 has a level detector 121 and a signal-amplification-amount determiner 122. The level detector 121 detects the level of the input sound signal SA. The signal-amplification-amount determiner 122 determines a signal amplification amount corresponding to the input-sound-signal SA level detected by the level detector 121 and outputs a sound-image control parameter indicative of a signal amplification amount.

Figure 8A:
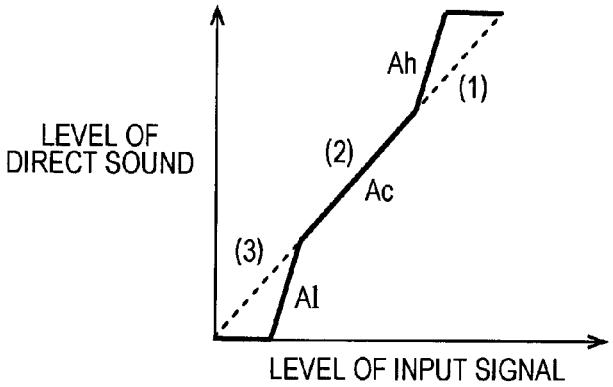
FIGS. 8A and 8B illustrate one example of control operation of a signal amplification amount of a direct-sound signal, the control operation being performed by the sound-pressure controller.
Figure 8B:
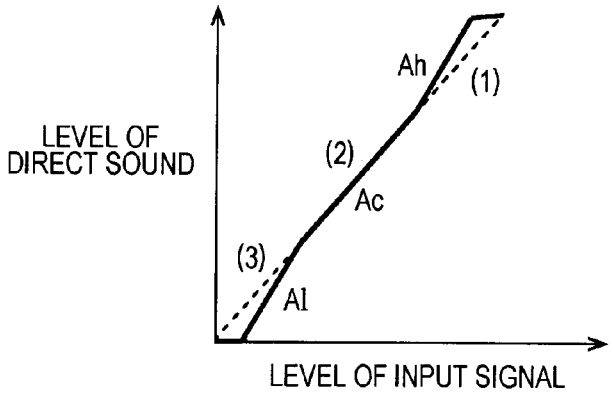

FIGS. 8A and 8B illustrate one example of control operation of the signal amplification amount of a direct-sound signal, the control operation being performed by the sound-pressure controller 116. That is, with respect to a medium level range (i.e., range (2)) in which the level of the input sound signal SA is within a predetermined level range, the sound-pressure controller 116 sets the signal amplification amount of the direct-sound signal to, for example, "Ac".

In contrast, with respect to a level range (range (1)) that is higher than a first level at the upper end of the medium level range, the sound-pressure controller 116 sets the signal amplification amount of the direct-sound signal to, for example, "Ah", which is larger than "Ac". As a result of the control, the sound image originally perceived as being close because of the high level of the input sound signal SA is perceived as being even closer, so that the sense of depth to the sound image is enhanced.

With respect to a level range (range (3)) that is lower than a second level at the lower end of the medium level range, the sound-pressure controller 116 sets the signal amplification amount of the direct-sound signal to, for example, "Al", which is smaller than "Ac". As a result of the control, the sound image originally perceived as being far because of the low level of the input sound signal SA is perceived as being even farther, so that the sense of depth to the sound image is enhanced.

By operating the user operation unit 102, the listener can switch the degree of enhancement of the sense of depth to the sound image intermittently in a stepped manner or in sequence. For example, the conceivable listener's sense of distance differs depending upon, for example, whether the equipment used is portable equipment, such as portable game equipment, or a large-size television receiver. By switching the degree of enhancement of the sense of depth to the sound image, the listener can enhance the sense of distance suitable for the equipment used.

FIGS. 8A and 8B illustrate an example of switching in two steps. In FIG. 8A, amounts of changes in the signal amplification amount "Ah" in the high level range and the signal amplification amount "Al" in the low level range relative to the signal amplification amount "Ac" in the medium level range are increased, so that the degree of enhancement of the sense of depth increases. In FIG. 8B, amounts of changes in the signal amplification amount "Ah" in the high level range and the signal amplification amount "Al" in the low level range relative to the signal amplification amount "Ac" in the medium level range are reduced, so that the degree of enhancement of the sense of depth also decreases.

Figure 9A:
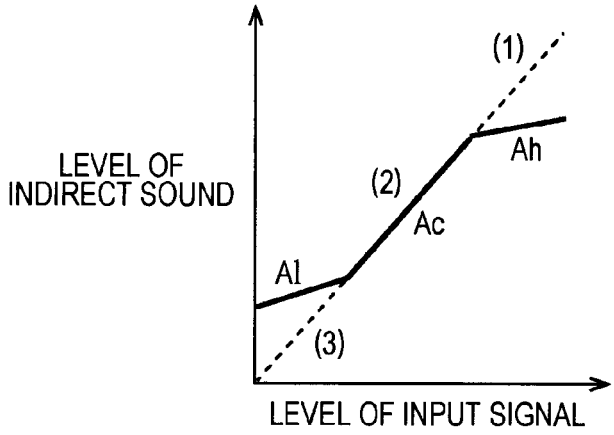
FIGS. 9A and 9B illustrate one example of control operation of a signal amplification amount of an indirect-sound signal, the control operation being performed by the sound-pressure controller.
Figure 9B:
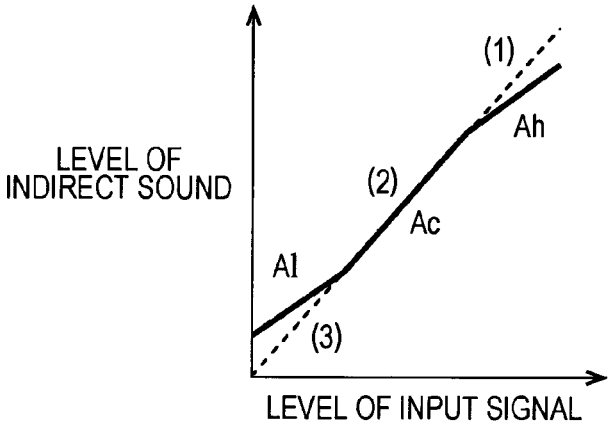

FIGS. 9A and 9B illustrate an example of control operation of the signal amplification amount of an indirect-sound signal, the control operation being performed by the sound-pressure controller 117. The sound-pressure controller 117 controls the signal amplification amount so that it has a reverse characteristic of the characteristic of the signal amplification amount controlled by the sound-pressure controller 116. With respect to a medium level range (i.e., range (2)) in which the level of the input sound signal SA is within a predetermined level range, the sound-pressure controller 117 sets the signal amplification amount of the indirect-sound signal to, for example, "Ac".

In contrast, with respect to a level range (range (1)) that is higher than a first level at the upper end of the medium level range, the sound-pressure controller 117 sets the signal amplification amount of the indirect-sound signal to, for example, "Ah", which is smaller than "Ac". As a result of the control, the sound image originally perceived as being close because of the high level of the input sound signal SA is perceived as being even closer, so that the sense of depth to the sound image is enhanced.

With respect to a level range (range (3)) that is lower than a second level at the lower end of the medium level range, the sound-pressure controller 117 sets the signal amplification amount of the indirect-sound signal to, for example, "Al", which is larger than "Ac". As a result of the control, the sound image originally perceived as being far because of the low level of the input sound signal SA is perceived as being even farther, so that the sense of depth to the sound image is enhanced.

By operating the user operation unit 102, the listener can switch the degree of enhancement of the sense of depth to the sound image intermittently in a stepped manner or in sequence. For example, the conceivable listener's sense of distance differs depending upon, for example, whether the equipment used is portable equipment, such as portable game equipment, or a large-size television receiver. By switching the degree of enhancement of the sense of depth to the sound image, the listener can enhance the sense of distance according to equipment used.

FIGS. 9A and 9B illustrate an example of switching in two steps. In FIG. 9A, amounts of changes in the signal amplification amount "Ah" in the high level range and the signal amplification amount "Al" in the low level range relative to the signal amplification amount "Ac" in the medium level range are increased, so that the degree of enhancement of the sense of depth increases. In FIG. 9B, amounts of changes in the signal amplification amount "Ah" in the high level range and the signal amplification amount "Al" in the low level range relative to the signal amplification amount "Ac" in the medium level range are reduced, so that the degree of enhancement of the sense of depth decreases.

Figure 10:
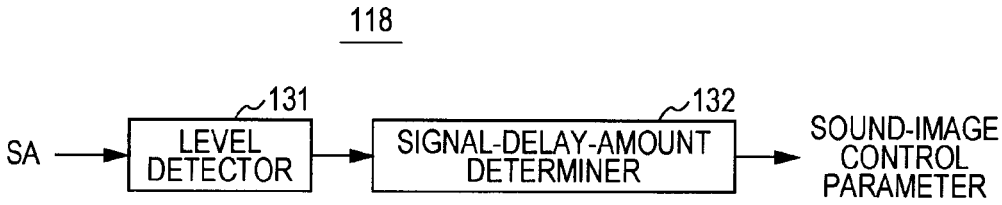
FIG. 10 is a block diagram illustrating an example of the configuration of a delay controller included in the sound-image control circuit.

FIG. 10 illustrates an example of the configuration of the delay controller 118. The delay controller 118 has a level detector 131 and a signal-delay-amount determiner 132. The level detector 131 detects the level of the input sound signal SA. The signal-delay-amount determiner 132 determines a signal delay amount corresponding to the input-sound-signal SA level detected by the level detector 131 and outputs a sound-image control parameter indicative of the signal delay amount.

Figure 11A:
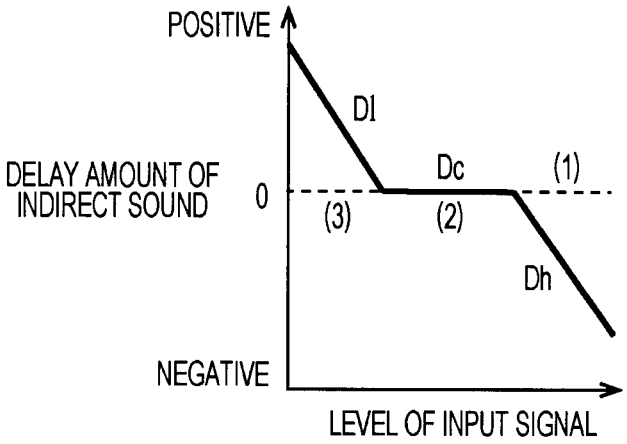
FIGS. 11A and 11B illustrate one example of control operation of a signal delay amount of an indirect-sound signal, the control operation being performed by the delay controller.
Figure 11B:
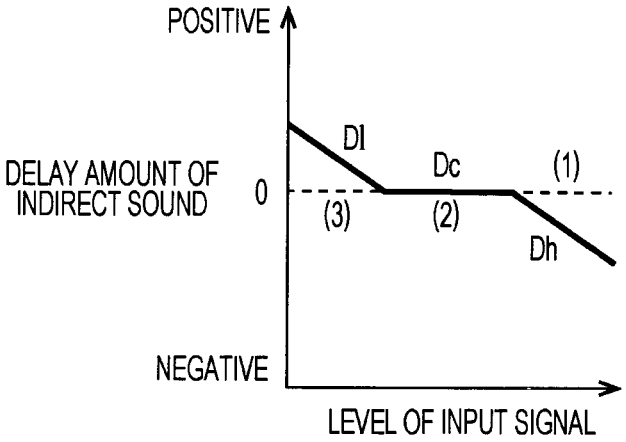

FIGS. 11A and 11B illustrate an example of control operation of the signal delay amount of an indirect-sound signal, the control operation being performed by the delay controller 118. That is, with respect to a medium level range (i.e., range (2)) in which the level of the input sound signal SA has a predetermined width, the delay controller 118 sets the signal delay amount of the indirect-sound signal to, for example, "Dc".

In contrast, with respect to a level range (range (1)) that is higher than a first level at the upper end of the medium level range, the delay controller 118 sets the signal amplification amount of the indirect-sound signal to, for example, "Dh", which is smaller than "Dc". As a result of the control, the sound image originally perceived as being close because of the high level of the input sound signal SA is perceived as being even closer, so that the sense of depth to the sound image is enhanced.

With respect to a level range (range (3)) that is lower than a second level at the lower end of the medium level range, the delay controller 118 sets the signal amplification amount of the indirect-sound signal to, for example, "Dl", which is larger than "Dc". As a result of the control, the sound image originally perceived as being far because of the low level of the input sound signal SA is perceived as being even farther, so that the sense of depth to the sound image is enhanced.

By operating the user operation unit 102, the listener can switch the degree of enhancement of the sense of depth to the sound image intermittently in a stepped manner or in sequence. For example, the conceivable listener's sense of distance differs depending upon, for example, whether the equipment used is portable equipment, such as portable game equipment, or a large-size television receiver. By switching the degree of enhancement of the sense of depth to the sound image, the listener can enhance the sense of distance suitable for the equipment used.

FIGS. 11A and 11B illustrate an example of switching in two steps. In FIG. 11A, amounts of changes in the signal delay amount "Dh" in the high level range and the signal delay amount "Dl" in the low level range relative to the signal delay amount "Dc" in the medium level range are increased, so that the degree of enhancement of the sense of depth increases. In FIG. 11B, amounts of changes in the signal delay amount "Dh" in the high level range and the signal delay amount "Dl" in the low level range relative to the signal delay amount "Dc" in the medium level range are reduced, so that the degree of enhancement of the sense of depth decreases.

Figure 12:
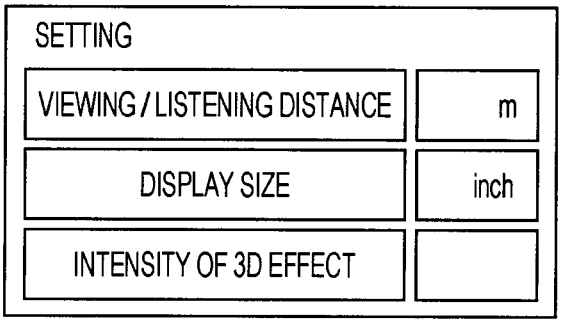
FIG. 12 illustrates one example of a GUI displayed on a display unit when a listener (user) switches the degree of enhancement of the sense of depth to a sound image.

FIG. 12 illustrates one example of a GUI (graphical user interface) displayed on the display unit 103 when the listener (user) switches the degree of enhancement of the sense of depth to a sound image. Using the GUI, the listener inputs a viewing/listening distance, a display size, an intensity of a 3D (three-dimensional) effect in a 3D image, and so on. In accordance with the contents of the input information, the controller 101 switches the degree of enhancement of the sense of depth to a sound image. For example, the degree of enhancement is increased as the display size increases. Also, for example, the degree of enhancement is increased as the viewing/listening distance increases.

A description will be given of the sound-image control circuit 100 illustrated in FIG. 3. The input sound signal SA is supplied to the direct-sound FIR filter 111, the indirect-sound FIR filter 112, the sound-pressure controllers 116 and 117, and the delay controller 118. The direct-sound FIR filter 111 performs filter processing on the input sound signal SA, i.e., convolves the input sound signal SA with the direct-sound coefficient data, to generate a direct-sound signal. The direct-sound signal is input to the amplifier 114.

The sound-pressure controller 116 detects the level of the input sound signal SA, determines a signal amplification amount corresponding to the detected level (see FIGS. 8A and 8B), and outputs a sound-image control parameter indicative of the determined signal amplification amount. The sound-image control parameter indicative of the signal amplification amount is supplied from the sound-pressure controller 116 to the amplifier 114. On the basis of the sound-image control parameter indicative of the signal amplification amount, the amplifier 114 amplifies the direct-sound signal generated by the direct-sound FIR filter 111.

The indirect-sound FIR filter 112 performs filter processing on the input sound signal SA, i.e., convolves the input sound signal SA with the indirect-sound coefficient data, to generate an indirect-sound signal. The indirect-sound signal is input to the delay unit 113.

The delay controller 118 detects the level of the input sound signal SA, determines a signal delay amount corresponding to the detected level (see FIGS. 11A and 11B), and outputs a sound-image control parameter indicative of the determined signal delay amount. The sound-image control parameter indicative of the signal delay amount is supplied from the delay controller 118 to the delay unit 113. On the basis of the sound-image control parameter indicative of the signal delay amount, the delay unit 113 delays the indirect-sound signal generated by the indirect-sound FIR filter 112.

The indirect-sound signal delayed by the delay unit 113 is supplied to the amplifier 115. The sound-pressure controller 117 detects the level of the input sound signal SA, determines a signal amplification amount corresponding to the detected level (see FIGS. 9A and 9B), and outputs a sound-image control parameter indicative of the determined signal amplification amount. The sound-image control parameter indicative of the signal amplification amount is supplied from the sound-pressure controller 117 to the amplifier 115. On the basis of the sound-image control parameter indicative of the signal amplification amount, the amplifier 115 amplifies the indirect-sound signal input from the delay unit 113.

The direct-sound signal amplified by the amplifier 114 is supplied to the adder 119. The indirect-sound signal amplified by the amplifier 115 is also supplied to the adder 119. The adder 119 adds the direct-sound signal and the indirect-sound signal to obtain an output sound signal SA'.

As described above, the sound-image control circuit 100 (which corresponds to the sound-image control circuits 100LL, 100LR, 100RR, and 100RL) in the sound-image control device 10 illustrated in FIG. 1 performs the following control on the direct-sound signal. That is, in accordance with the level of the input sound signal SA, the signal amplification amount in the high level range is increased compared to the signal amplification amount in the medium level range and the signal amplification amount in the low level range is reduced compared to the signal amplification amount in the medium level range.

With respect to the indirect-sound signal, the sound-image control circuit 100 reduces the signal amplification amount in the high level range compared to the signal amplification amount in the medium level range and increases the signal amplification amount in the low level range compared to the signal amplification amount in the medium level range, in accordance with the level of the input sound signal SA. In addition, with respect to the indirect-sound signal, the sound-image control circuit 100 reduces the signal delay amount in the high level range compared to the signal delay amount in the medium level range and increases the signal delay amount in the low level range compared to the signal delay amount in the medium level range, in accordance with the level of the input sound signal SA.

Figure 13A:
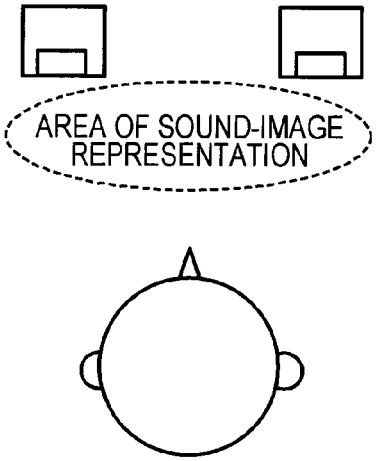
FIGS. 13A and 13B schematically illustrate an effect of controlling the sense of distance to a sound image, included in an original sound signal, so that the sense of depth is further enhanced.
Figure 13B:
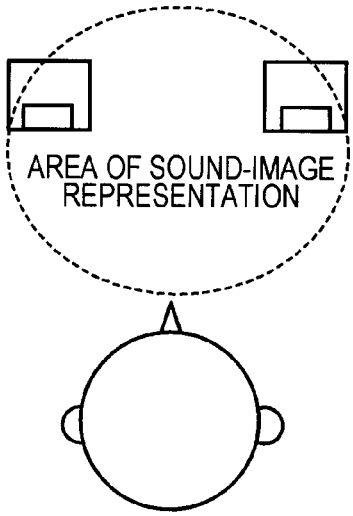

As a result of the control, the sound image originally perceived as being close because of the high level of the input sound signal SA is perceived as being even closer and the sound image originally perceived as being far because of the low level of the input sound signal SA is perceived as being even farther. It is, therefore, possible to control the sense of distance to the sound image, included in the original sound signal, so that the sense of depth is further enhanced. FIG. 13A schematically illustrates an area in which the sound image resulting from the original sound signal is represented. FIG. 13B schematically illustrates an area in which a sound image obtained by controlling the sense of distance to a sound image, included in the original sound signal, so that the sense of depth is further enhanced is represented.

2. Second Embodiment

[Example of Configuration of Sound Image Control Device]

Figure 14:
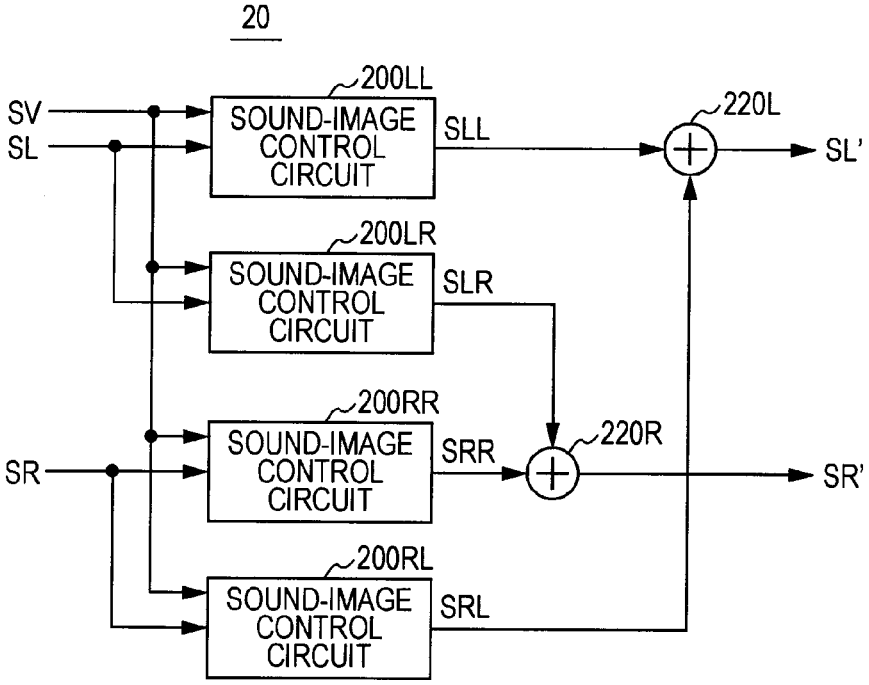
FIG. 14 is a block diagram illustrating an example of the configuration of a sound-image control device according to a second embodiment of the present technology.

FIG. 14 illustrates an example of the configuration of a sound-image control device 20 according to a second embodiment. A description will be given of an example in which the sound-image control device 20 is applied to a headphone apparatus for reproducing 2-channel stereo sound signals. The sound-image control device 20 includes sound-image control circuits 200LL, 200LR, 200RR, and 200RL, and adders 220L and 220R.

The sound-image control circuit 200LL has a filter having the transmission characteristic HLL of sound reaching from the left speaker SPL to the left ear of the listener M (see FIG. 2). The sound-image control circuit 200LL performs filter processing on an input left sound signal SL to generate a left sound signal SLL to be input to the left ear of the listener M. The sound-image control circuit 200LR has a filter having the transmission characteristic HLR of sound reaching from the left speaker SPL to the right ear of the listener M (see FIG. 2). The sound-image control circuit 200LR performs filter processing on the input left sound signal SL to generate a left sound signal SLR to be input to the right ear of the listener M.

The sound-image control circuit 200RR has a filter having the transmission characteristic HRR of sound reaching from the right speaker SPR to the right ear of the listener M (see FIG. 2). The sound-image control circuit 200RR performs filter processing on an input right sound signal SR to generate a right sound signal SRR to be input to the right ear of the listener M. The sound-image control circuit 200RL has a filter having the transmission characteristic HRL of sound reaching from the left speaker SPR to the left ear of the listener M (see FIG. 2). The sound-image control circuit 200RL performs filter processing on the input right sound signal SR to generate a right sound signal SRL to be input to the left ear of the listener M.

In addition to the filter processing described above, the sound-image control circuits 200LL, 200LR, 200RR, and 200RL perform sound-image control processing in accordance with the levels of the input sound signals and information of parallax between left-eye video and right-eye video included in three-dimensional video. The sound-image control processing involves control of a signal amplification amount of a direct-sound signal, control of a signal amplification amount of an indirect-sound signal, control of a signal delay amount of an indirect-sound signal, and so on.

The adder 220L adds the right sound signal SRL, generated by the sound-image control circuit 200RL, to the left sound signal SLL, generated by the sound-image control circuit 200LL, to obtain a left sound signal SL' to be supplied to a left speaker of a headphone (not illustrated). The adder 220R adds the left sound signal SLR, generated by the sound-image control circuit 200LR, to the right sound signal SRR, generated by the sound-image control circuit 200RR, to obtain a right sound signal SR' to be supplied to the right speaker of the headphone (not illustrated).

An operation of the sound-image control device 20 illustrated in FIG. 14 will be briefly described next. The left sound signal SL is supplied to the sound-image control circuits 200LL and 200LR. Video signals SV including a left-eye video signal and a right-eye video signal are also supplied to the sound-image control circuits 200LL and 200LR. The sound-image control circuit 200LL performs filter processing on the left sound signal SL and further performs sound-image control processing on the basis of the level of the input sound signal and the information of the parallax between the left-eye video and the right-eye video to thereby generate a left sound signal SLL to be input to the left ear of the listener M. The sound-image control circuit 200LR performs filter processing on the left sound signal SL and further performs sound-image control processing on the basis of the level of the input sound signal and the information of the parallax between the left-eye video and the right-eye video to thereby generate a left sound signal SLR to be input to the right ear of the listener M.

The right sound signal SR is supplied to the sound-image control circuits 200RR and 200RL. The video signals SV including the left-eye video signal and the right-eye video signal are also supplied to the sound-image control circuits 200RR and 200RL. The sound-image control circuit 200RR performs filter processing on the right sound signal SR and further performs sound-image control processing on the basis of the level of the input sound signal and the information of the parallax between the left-eye video and the right-eye video to thereby generate a right sound signal SRR to be input to the right ear of the listener M. The sound-image control circuit 200RL performs filter processing on the right sound signal SR and further performs sound-image control processing on the basis of the level of the input sound signal and the information of the parallax between the left-eye video and the right-eye video to thereby generate a right sound signal SRL to be input to the left ear of the listener M.

The left sound signal SLL generated by the sound-image control circuit 200LL and the right sound signal SRL generated by the sound-image control circuit 200RL are supplied to the adder 220L. The adder 220L adds the right sound signal SRL to the left sound signal SLL to obtain a left sound signal SL' to be supplied to the left speaker of the headphone. The right sound signal SRR generated by the sound-image control circuit 200RR and the left sound signal SLR generated by the sound-image control circuit 200LR are supplied to the adder 220R. The adder 220R adds the left sound signal SLR to the right sound signal SRR to obtain a right sound signal SR' to be supplied to the right speaker of the headphone.

Figure 15:
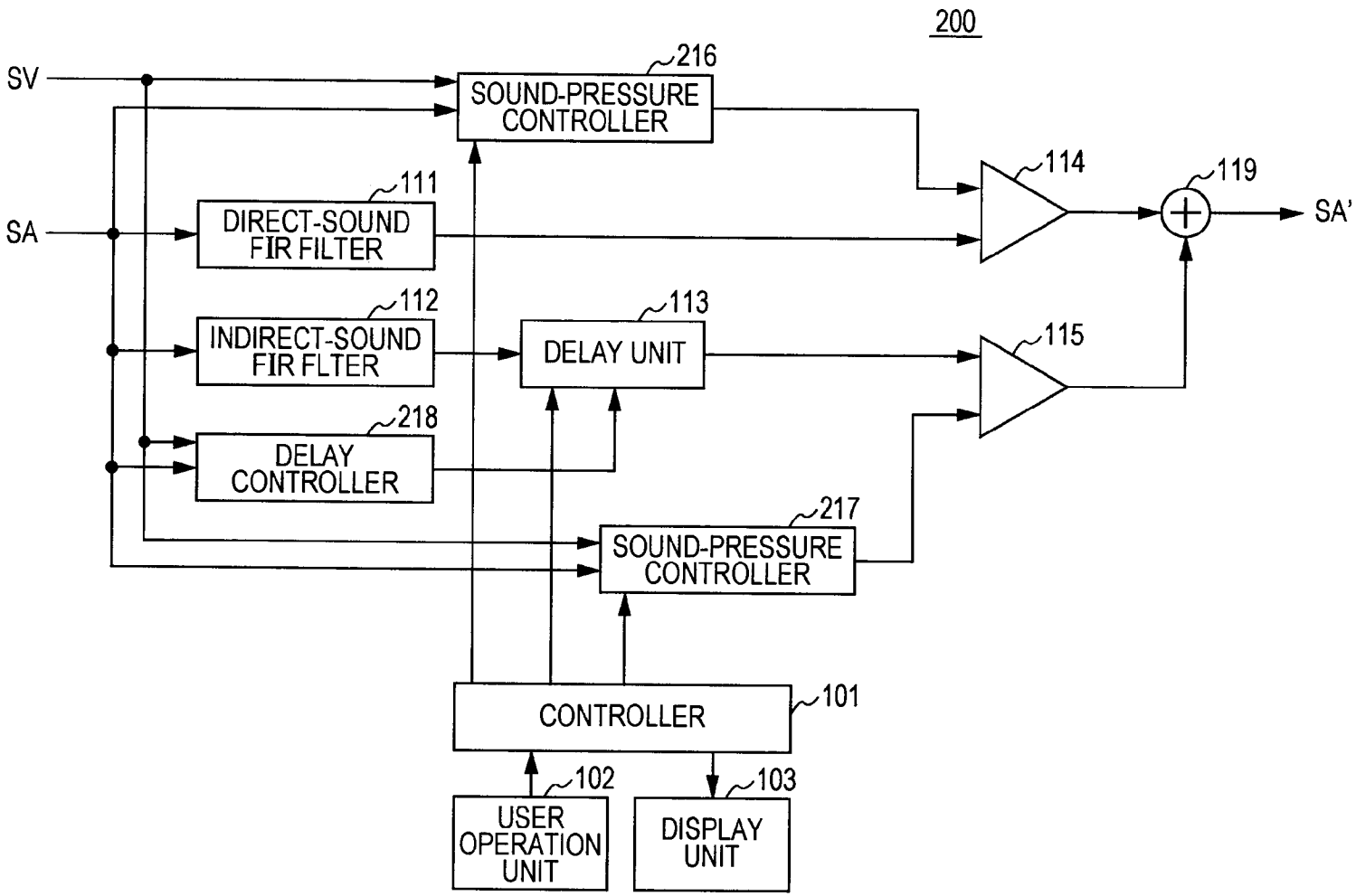
FIG. 15 is a block diagram illustrating an example of the configuration of a sound-image control circuit included in the sound-image control device.

FIG. 15 illustrates an example of the configuration of a sound-image control circuit 200 (which corresponds to the sound-image control circuits 200LL, 200LR, 200RR, and 200RL). In FIG. 15, elements corresponding to those illustrated in FIG. 3 are denoted by the same reference numerals and detailed descriptions thereof are omitted as appropriate. The sound-image control circuit 200 has a controller 101, a user operation unit 102, and a display unit 103. The sound-image control circuit 200 further has a direct-sound FIR filter 111, an indirect-sound FIR filter 112, a delay unit 113, amplifiers 114 and 115, sound-pressure controllers 216 and 217, a delay controller 218, and an adder 119.

A sound-image control parameter indicative of a signal delay amount is supplied from the delay controller 218 to the delay unit 113. On the basis of the sound-image control parameter indicative of the signal delay amount, the delay unit 113 delays the indirect-sound signal generated by the indirect-sound FIR filter 112. A sound-image control parameter indicative of the signal amplification amount is supplied from the sound-pressure controller 216 to the amplifier 114. On the basis of the sound-image control parameter indicative of the signal amplification amount, the amplifier 114 amplifies the direct-sound signal generated by the direct-sound FIR filter 111. A sound-image control parameter indicative of the signal amplification amount is also supplied from the sound-pressure controller 217 to the amplifier 115. On the basis of the sound-image control parameter indicative of the signal amplification amount, the amplifier 115 amplifies the indirect-sound signal delayed by the delay unit 113.

Figure 16:
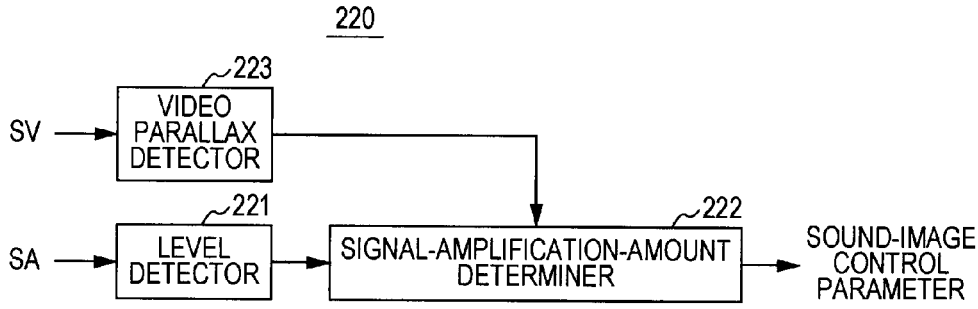
FIG. 16 is a block diagram illustrating an example of the configuration of a sound-pressure controller included in the sound-image control circuit.

FIG. 16 illustrates an example of the configuration of a sound-pressure controller 220 (the sound-pressure controller 116 and the sound-pressure controller 117). The sound-pressure controller 220 has a level detector 221, a signal-amplification-amount determiner 222, and a video-parallax detector 223. The level detector 221 detects the level of the input sound signal SA. The video-parallax detector 223 detects information of parallax between left-eye video and right-eye video on the basis of a left-eye video signal and a right-eye video signal included in three-dimensional video signals SV. The signal-amplification-amount determiner 222 determines a signal amplification amount corresponding to the input-sound-signal SA level detected by the level detector 221 and the information of the parallax detected by the video-parallax detector 223 and outputs a sound-image control parameter indicative of the signal amplification amount.

Figure 17:
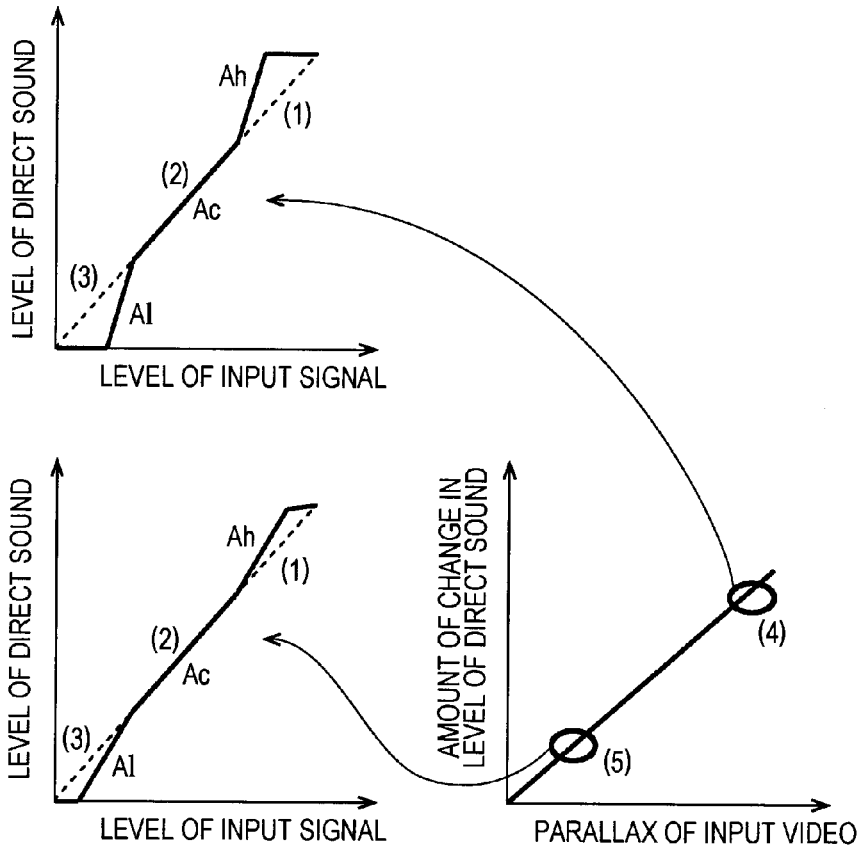
FIG. 17 illustrates one example of control operation of a signal amplification amount of a direct-sound signal, the control operation being performed by the sound-pressure controller.

FIG. 17 illustrates one example of control operation of the signal amplification amount of a direct-sound signal, the control operation being performed by the sound-pressure controller 216. That is, with respect to a medium level range (i.e., range (2) in FIG. 17) in which the level of the input sound signal SA is within a predetermined level range, the sound-pressure controller 216 sets the signal amplification amount of the direct-sound signal to, for example, "Ac".

In contrast, with respect to a level range (range (1) in FIG. 17) that is higher than a first level at the upper end of the medium level range, the sound-pressure controller 216 sets the signal amplification amount of the direct-sound signal to, for example, "Ah", which is larger than "Ac". As a result of the control, the sound image originally perceived as being close because of the high level of the input sound signal SA is perceived as being even closer, so that the sense of depth to the sound image is enhanced.

With respect to a level range (range (3) in FIG. 17) that is lower than a second level at the lower end of the medium level range, the sound-pressure controller 216 sets the signal amplification amount of the direct-sound signal to, for example, "Al", which is smaller than "Ac". As a result of the control, the sound image originally perceived as being far because of the low level of the input sound signal SA is perceived as being even farther, so that the sense of depth to the sound image is enhanced.

When the parallax (the absolute value thereof) is large, i.e., when there are objects whose positions in the depth direction in three-dimensional video are greatly distant from each other at near and far sides relative to the screen position (see position (4) in FIG. 17), the sound-pressure controller 216 performs control in the following manner. That is, the sound-pressure controller 216 increases the amounts of change in the signal amplification amount "Ah" in the high level range and the signal amplification amount "Al" in the low level range relative to the signal amplification amount "Ac" in the medium level range. As a result of the control, for video whose 3D effect at the near and far sides is to be greatly enhanced, the degree of enhancement of the sense of depth increases.

When the parallax (the absolute value thereof) is small, i.e., when the positions of objects in the depth direction in three-dimensional video are not so distant from each other at near and far sides relative to the screen position (see position (5) in FIG. 17), the sound-pressure controller 216 performs control in the following manner. That is, the sound-pressure controller 216 reduces the amounts of change in the signal amplification amount "Ah" in the high level range and the signal amplification amount "Al" in the low level range relative to the signal amplification amount "Ac" in the medium level range. As a result of the control, for video whose three-dimensional effect is not to be so enhanced, the degree of enhancement of the sense of depth is reduced.

Figure 18:
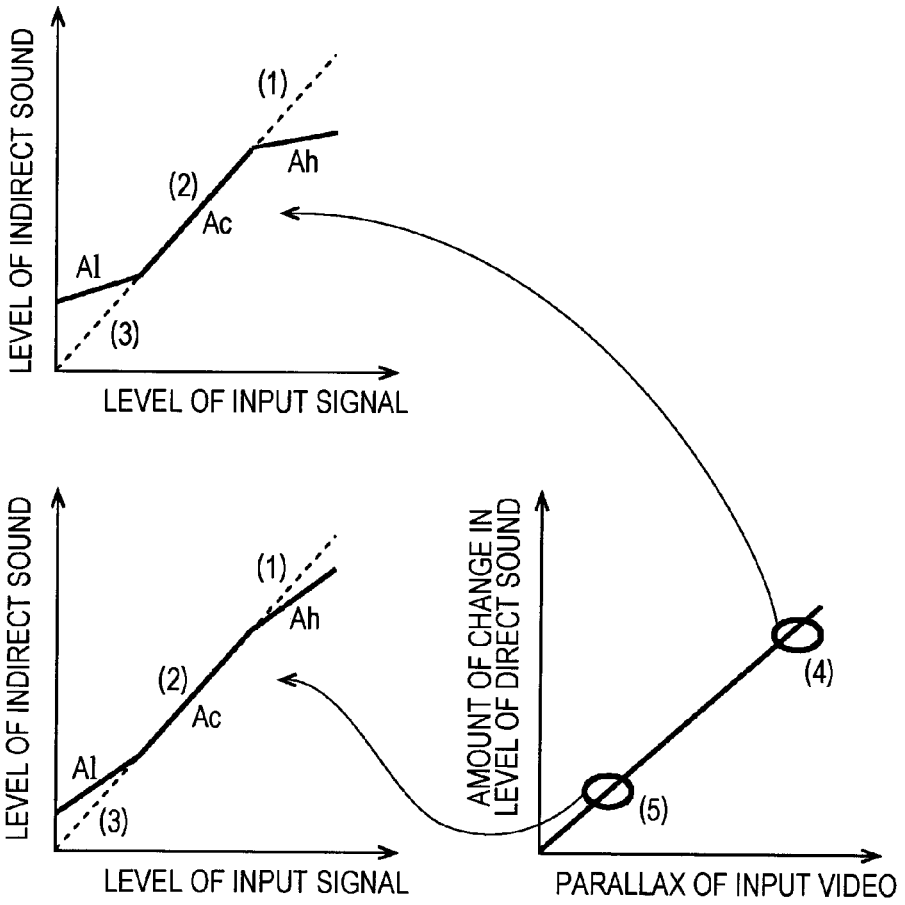
FIG. 18 illustrates one example of control operation of a signal amplification amount of an indirect-sound signal, the control operation being performed by the sound-pressure controller.

FIG. 18 illustrates one example of control operation of the signal amplification amount of an indirect-sound signal, the control operation being performed by the sound-pressure controller 217. The sound-pressure controller 217 controls the signal amplification amount so that it has a reverse characteristic of the characteristic of the signal amplification amount controlled by the sound-pressure controller 216. With respect to a medium level range (i.e., range (2) in FIG. 18) in which the level of the input sound signal SA is within a predetermined level range, the sound-pressure controller 217 sets the signal amplification amount of the indirect-sound signal to, for example, "Ac".

In contrast, with respect to a level range (range (1) in FIG. 18) that is higher than a first level at the upper end of the medium level range, the sound-pressure controller 217 sets the signal amplification amount of the indirect-sound signal to, for example, "Ah", which is smaller than "Ac". As a result of the control, the sound image originally perceived as being close because of the high level of the input sound signal SA is perceived as being even closer, so that the sense of depth to the sound image is enhanced.

With respect to a level range (range (3) in FIG. 18) that is lower than a second level at the lower end of the medium level range, the sound-pressure controller 217 sets the signal amplification amount of the indirect-sound signal to, for example, "Al", which is larger than "Ac". As a result of the control, the sound image originally perceived as being far because of the low level of the input sound signal SA is perceived as being even farther, so that the sense of depth to the sound image is enhanced.

When the parallax (the absolute value thereof) is large, i.e., when there are objects whose positions in the depth direction in three-dimensional video are greatly distant from each other at near and far sides relative to the screen position (see position (4) in FIG. 18), the sound-pressure controller 217 performs control in the following manner. That is, the sound-pressure controller 217 increases the amounts of change in the signal amplification amount "Ah" in the high level range and the signal amplification amount "Al" in the low level range relative to the signal amplification amount "Ac" in the medium level range. As a result of the control, for video whose 3D effect at the near and far sides is to be greatly enhanced, the degree of enhancement of the sense of depth increases.

When the parallax (the absolute value thereof) is small, i.e., when the positions of objects in the depth direction in three-dimensional video are not so distant from each other at near and far sides relative to the screen position (see position (5) in FIG. 18), the sound-pressure controller 217 performs control in the following manner. That is, the sound-pressure controller 217 reduces the amounts of change in the signal amplification amount "Ah" in the high level range and the signal amplification amount "Al" in the low level range relative to the signal amplification amount "Ac" in the medium level range. As a result of the control, for video whose three-dimensional effect is not to be so enhanced, the degree of enhancement of the sense of depth is reduced.

Figure 19:
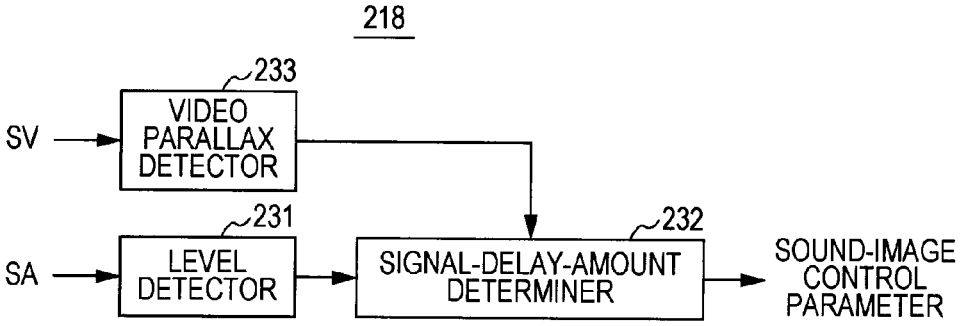
FIG. 19 is a block diagram illustrating an example of the configuration of a delay controller included in the sound-image control circuit.

FIG. 19 illustrates an example of the configuration of the delay controller 218. The delay controller 218 has a level detector 231, a signal-delay-amount determiner 232, and a video-parallax detector 233. The level detector 231 detects the level of the input sound signal SA. Similarly to the video-parallax detector 223 in the sound-image control circuit 200 described above, the video-parallax detector 233 detects information of parallax between left-eye video and right-eye video on the basis of a left-eye video signal and a right-eye video signal included in three-dimensional video signals SV. The signal-delay-amount determiner 232 determines a signal delay amount corresponding to the input-sound-signal SA level detected by the level detector 231 and the information of the parallax detected by the video-parallax detector 233 and outputs a sound-image control parameter indicative of the signal delay amount.

Figure 20:
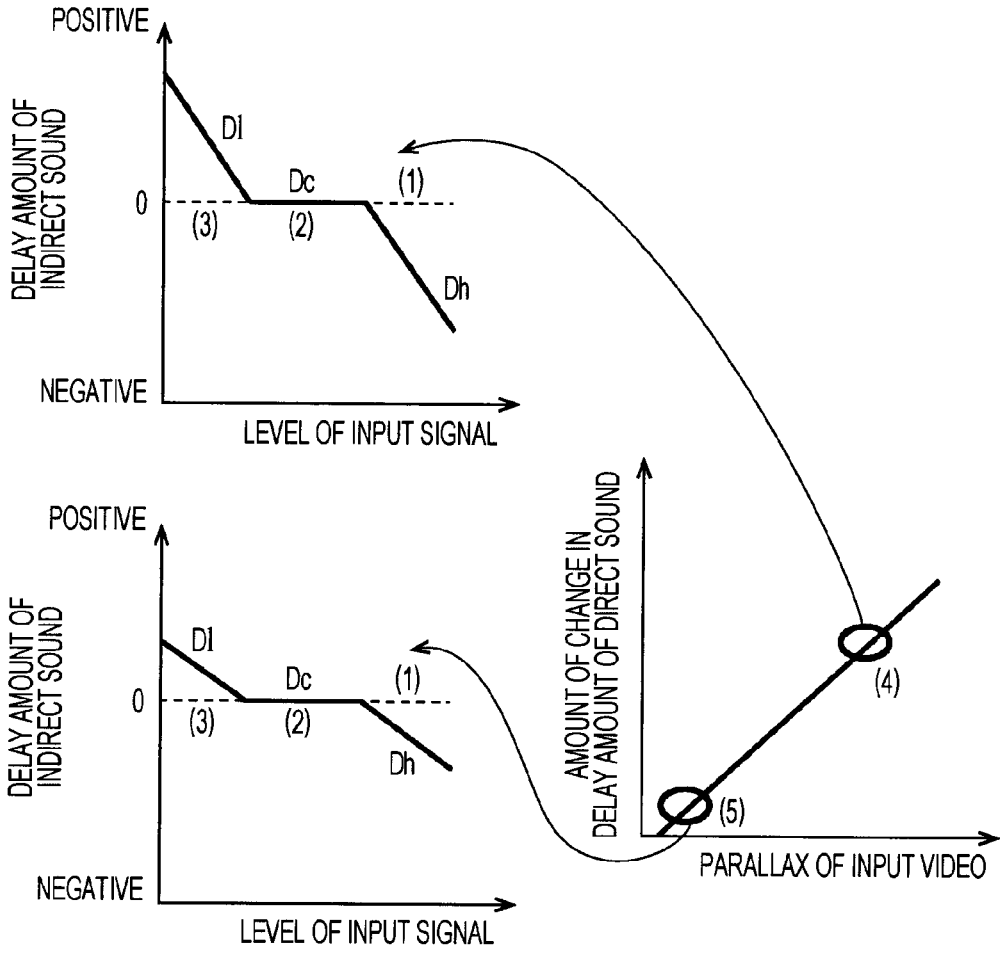
FIG. 20 illustrates one example of control operation of a signal delay amount of an indirect-sound signal, the control operation being performed by the delay controller.

FIG. 20 illustrates one example of control operation of the signal delay amount of an indirect-sound signal, the control operation being performed by the delay controller 218. That is, with respect to a medium level range (i.e., range (2) in FIG. 20) in which the level of the input sound signal SA has a predetermined width, the delay controller 218 sets the signal delay amount of the indirect-sound signal to, for example, "Dc".

In contrast, with respect to a level range (range (1) in FIG. 20) that is higher than a first level at the upper end of the medium level range, the delay controller 218 sets the signal delay amount of the indirect-sound signal to, for example, "Dh", which is smaller than "Dc". As a result of the control, the sound image originally perceived as being close because of the high level of the input sound signal SA is perceived as being even closer, so that the sense of depth to the sound image is enhanced.

With respect to a level range (range (3) in FIG. 20) that is lower than a second level at the lower end of the medium level range, the delay controller 218 sets the signal delay amount of the indirect-sound signal to, for example, "Dl", which is larger than "Dc". As a result of the control, the sound image originally perceived as being far because of the low level of the input sound signal SA is perceived as being even farther, so that the sense of depth to the sound image is enhanced.

When the parallax (the absolute value thereof) is large, i.e., when there are objects whose positions in the depth direction in three-dimensional video are greatly distant from each other at near and far sides relative to the screen position (see position (4) in FIG. 20), the delay controller 218 performs control in the following manner. That is, the delay controller 218 increases the amounts of change in the signal delay amount "Dh" in the high level range and the signal delay amount "Dl" in the low level range relative to the signal delay amount "Dc" in the medium level range. As a result of the control, for video whose 3D effect at the near and far sides is to be greatly enhanced, the degree of enhancement of the sense of depth increases.

When the parallax (the absolute value thereof) is small, i.e., when the positions of objects in the depth direction in three-dimensional video are not so distant from each other at near and far sides relative to the screen position (see position (5) in FIG. 20), the delay controller 218 performs control in the following manner. That is, the delay controller 218 reduces the amounts of change in the signal delay amount "Dh" in the high level range and the signal delay amount "Dl" in the low level range relative to the signal delay amount "Dc" in the medium level range. As a result of the control, for video whose three-dimensional effect is not to be so enhanced, the degree of enhancement of the sense of depth is reduced.

A description will be given of the sound-image control circuit 200 illustrated in FIG. 15. The input sound signal SA is supplied to the direct-sound FIR filter 111, the indirect-sound FIR filter 112, the sound-pressure controllers 216 and 217, and the delay controller 218. Also, three-dimensional video signals SV including a left-eye video signal and a right-eye video signal are supplied to the sound-pressure controllers 216 and 217 and the delay controller 218.

The direct-sound FIR filter 111 performs filter processing on the input sound signal SA, i.e., convolves the input sound signal SA with the direct-sound coefficient data, to generate a direct-sound signal. This direct-sound signal is input to the amplifier 114. The sound-pressure controller 216 detects the level of the input sound signal SA and further detects information of parallax between the left-eye video and the right-eye video. The sound-pressure controller 216 determines a signal amplification amount (see FIG. 17) on the basis of the detected level of the input sound signal SA and the detected information of the parallax and outputs a sound-image control parameter indicative of the signal amplification amount.

The sound-image control parameter output from the sound-pressure controller 216 and indicative of the signal amplification amount is supplied to the amplifier 114. On the basis of the sound-image control parameter supplied from the sound-pressure controller 216 and indicative of the signal amplification amount, the amplifier 114 amplifies the direct-sound signal generated by the direct-sound FIR filter 111.

The indirect-sound FIR filter 112 performs filter processing on the input sound signal SA, i.e., convolves the input sound signal SA with the indirect-sound coefficient data, to generate an indirect-sound signal. The indirect sound signal is input to the delay unit 113. The delay controller 218 detects the level of the input sound signal SA and further detects information of parallax between the left-eye video and the right-eye video. The delay controller 218 determines a signal delay amount (see FIG. 20) on the basis of the detected level of the input sound signal SA and the detected information of the parallax and outputs a sound-image control parameter indicative of the signal delay amount.

The sound-image control parameter output from the delay controller 218 and indicative of the signal delay amount is supplied to the delay unit 113. On the basis of the sound-image control parameter supplied from the delay controller 218, the delay unit 113 delays the indirect-sound signal generated by the indirect-sound FIR filter 112.

The indirect-sound signal delayed by the delay unit 113 is supplied to the amplifier 115. The sound-pressure controller 217 detects the level of the input sound signal SA and further detects information of parallax between the left-eye video and the right-eye video. The sound-pressure controller 217 determines the signal amplification amount on the basis of the detected level of the input sound signal SA and the detected information of the parallax (see FIG. 18) and outputs a sound-image control parameter indicative of the signal amplification amount.

The sound-image control parameter output from the sound-pressure controller 217 and indicative of the signal amplification amount is supplied to the amplifier 115. On the basis of the sound-image control parameter supplied from the sound-pressure controller 117, the amplifier 115 amplifies the indirect-sound signal delayed by the delay unit 113.

The direct-sound signal amplified by the amplifier 114 is supplied to the adder 119. The indirect-sound signal amplified by the amplifier 115 is supplied to the adder 119. The adder 119 adds the direct-sound signal and the indirect-sound signal to obtain an output sound signal SA'.

As described above, the sound-image control circuit 200 (which correspond to the sound-image control circuits 200LL, 200LR, 200RR, and 200RL) in the sound-image control device 20 illustrated in FIG. 14 performs the following control on the direct-sound signal. That is, in accordance with the level of the input sound signal SA, the storage apparatus 200 increases the signal amplification amount in the high level range compared to the signal amplification amount in the medium level range and reduces the signal amplification amount in the low level range compared to the signal amplification amount in the medium level range.

With respect to the direct-sound signal, the sound-image control circuit 200 reduces the signal amplification amount in the high level range compared to the signal amplification amount in the medium level range and increases the signal amplification amount in the low level range compared to the signal amplification amount in the medium level range, in accordance with the level of the input sound signal SA. In addition, with respect to the indirect-sound signal, the sound-image control circuit 200 reduces the signal delay amount in the high level range compared to the signal delay amount in the medium level range and increases the signal delay amount in the low level range compared to the signal delay amount in the medium level range, in accordance with the level of the input sound signal SA.

As a result of the control, the sound image originally perceived as being close because of the high level of the input sound signal SA is perceived as being even closer and the sound image originally perceived as being far because of the low level of the input sound signal SA is perceived as being even farther. It is, therefore, possible to control the sense of distance to the sound image, included in the original sound signal, so that the sense of depth is further enhanced.

The sound-image control circuits 200 in the sound-image control device 20 illustrated in FIG. 14 control the degree of enhancement of the sense of depth on the basis of the information of the parallax between the left-eye video and the right-eye video. That is, when the parallax (the absolute value thereof) is large, i.e., when there are objects whose positions in the depth direction in three-dimensional video are greatly distant from each other at near and far sides relative to the screen position, the degree of enhancement of the sense of depth is increased. On the other hand, when the parallax (the absolute value thereof) is small, i.e., when the positions of objects in the depth direction in three-dimensional video are not so distant from each other at near and far sides relative to the screen position, the degree of enhancement of the sense of depth is reduced. This arrangement can achieve representation of a sound image that matches the three-dimensional video and that gives more enhanced sense of depth.

In the sound-image control circuit 200 illustrated in FIG. 15, the sound-pressure controllers 216 and 217 and the delay controller 218 obtain the information of the parallax between the left-eye video and the right-eye video from the three-dimensional video signals SV including the left-eye video signal and the right-eye video signal. However, the arrangement may also be such that the information of the parallax itself, not the three-dimensional video signals SV, is externally supplied to the sound-image control circuit 200. Although an example in which the sound-pressure controllers 216 and 217 and the delay controller 218 in the sound-image control circuit 200 illustrated in FIG. 15 individually obtain the respective pieces of information of the parallax has been described above, one of the sound-pressure controllers 216 and 217 and the delay controller 218 may obtain a piece of information of the parallax so that it is shared thereby.

The sound-image control circuit 200 illustrated in FIG. 15 controls the degree of enhancement of the sense of depth to the sound image, for example, in two steps (see FIGS. 17, 18, and 20), on the basis of the information of the parallax. The sound-image control circuit 200, however, may vary the degree of enhancement intermittently in more steps or in sequence. The sound-image control circuit 200 may also be configured so as to allow the listener to further adjust the degree of enhancement of the sense of depth to a sound image by operating the user operation unit 102, as in the sound-image control device 100 illustrated in FIG. 3.

3. Third Embodiment

[Example of Configuration of Sound Image Control Device]

Figure 21:
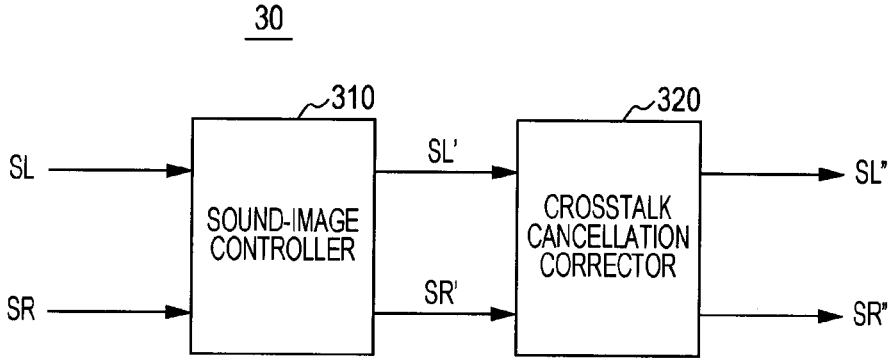
FIG. 21 is a block diagram illustrating an example of the configuration of a sound-image control device according to a third embodiment of the present technology.

FIG. 21 illustrates an example of the configuration of a sound-image control device 30 according to a third embodiment. A description will be given of an example in which the sound-image control device 30 is applied to a headphone apparatus for reproducing 2-channel stereo sound signals. The sound-image control device 30 has a sound-image controller 310 and a crosstalk cancellation corrector 320.

Although a detailed description is not given, the sound-image controller 310 has a configuration that is similar to that of the sound-image control device 10 illustrated in FIG. 1 or that of the sound-image control device 20 illustrated in FIG. 14. The crosstalk cancellation corrector 320 performs crosstalk cancellation processing on sound signals SL' and SR' output from the sound-image controller 310 and outputs a left-sound sound signal SL" to be supplied to a left speaker and a right sound signal SR" to be supplied to a right speaker.

The crosstalk cancellation processing is processing for generating sound for cancelling out sound to be heard by the opposite ear so that sound output from one of two speakers is heard by only one ear of the listener and sound output from the other of the two speakers is heard by only the other ear of the listener.

Figure 22:
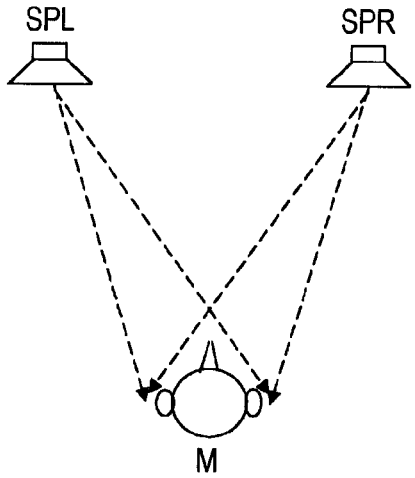
FIG. 22 illustrates a propagation state of sound reproduced by speakers and illustrates a state in which sound output from the left speaker is typically transmitted to both ears of a listener and sound output from the right speaker is also transmitted to both ears of the listener.

FIG. 22 illustrates a propagation state of sound reproduced by speakers. Typically, sound output from a left speaker SPL is transmitted to both ears of the listener M and sound output from a right speaker SPR is also transmitted to both ears of the listener M. As a result of the crosstalk cancellation processing described above, the sound output from the left speaker SPL and transmitted to the right ear is cancelled out and the sound output from the right speaker SPR and transmitted to the left ear is cancelled out.

Figure 23:
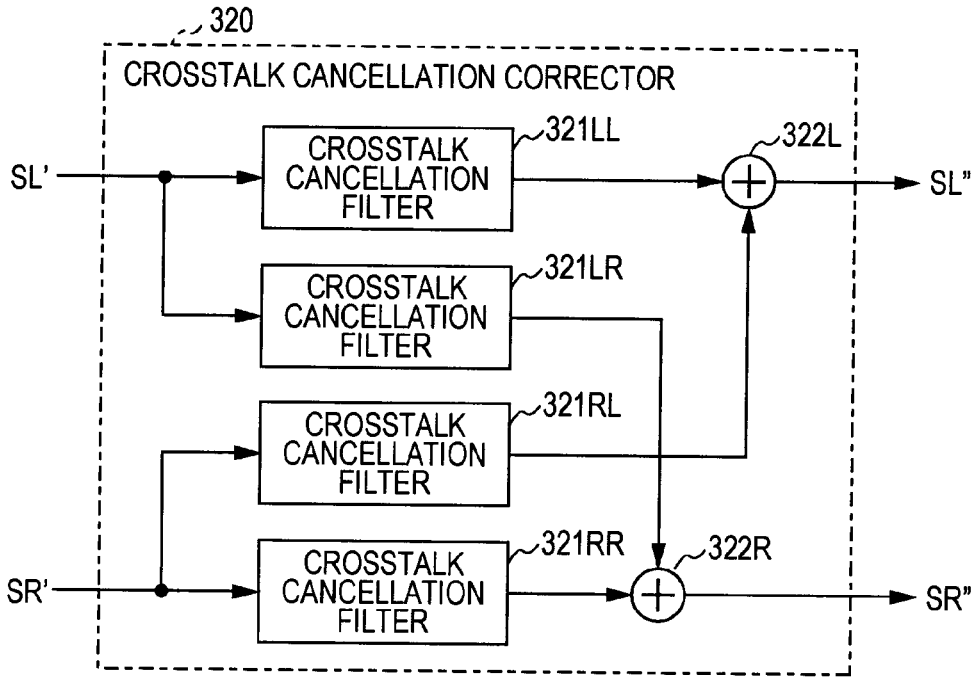
FIG. 23 is a block diagram illustrating an example of the configuration of a crosstalk cancellation corrector included in the sound-image control device.

FIG. 23 illustrates an example of the configuration of the crosstalk cancellation corrector 320. The crosstalk cancellation corrector 320 has crosstalk cancellation filters 321LL, 321LR, 321RL, and 321RR and adders 322L and 322R. Although a detailed description is not given, the crosstalk cancellation filters 321LL, 321LR, 321RL, and 321RR have filter coefficients set so as to cancel out sound output from the left speaker SPL and transmitted to the right ear and so as to cancel out sound output from the right speaker SPR and transmitted to the left ear.

Since the sound-image controller 310 included in the sound-image control device 30 illustrated in FIG. 21 has a configuration that is similar to those of the sound-image control device 10 illustrated in FIG. 1 and the sound-image control device 20 illustrated in FIG. 14, the sound-image control device 30 can offer advantages that are similar to those of the sound-image control devices 10 and 20. The crosstalk cancellation corrector 320 is provided at a subsequent stage of the sound-image controller 310 to cancel out the sound output from the left speaker SPL and transmitted to the right ear and to cancel out the sound output from the right speaker SPR and transmitted to the left ear. Thus, the sound-image control device 30 according to the third embodiment is advantageously applicable to a speaker apparatus for reproducing 2-channel stereo sound signals.

4. Modifications

Although all of the control of the signal amplification amount of a direct-sound signal, the control of the signal amplification amount of an indirect-sound signal, and the control of the signal delay amount of an indirect-sound signal are performed in the above-described embodiments, only part of the controls may also be performed. For example, only the control of the signal amplification amount of a direct-sound signal may be performed or the control of the signal amplification amount of a direct-sound signal and the control of the signal delay amount of an indirect-sound signal may be performed.

In the above-described embodiments, in accordance with the level of the input sound signal SA, the control is performed so that the signal amplification amount and the signal delay amount in the high level range and the low level range vary relative to those in the medium level range. However, the control may also be performed so that the signal amplification amount and the signal delay amount in either the high level range or the low level range vary relative to those in the medium level range. Although an example in which the medium level range has a relatively large width has been described in the above-described embodiments, a case in which the medium level range may have no width, i.e., the aforementioned first level and second level may be equal to each other, may also be conceivable.

Figure 24A:
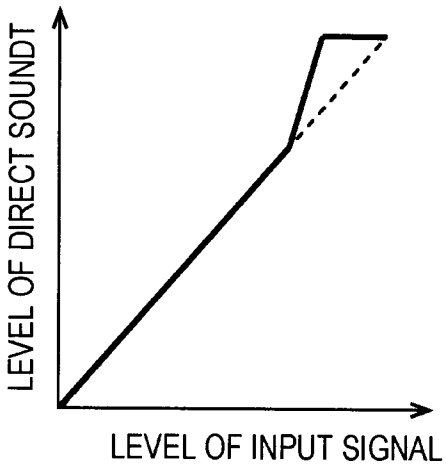
FIGS. 24A to 24C illustrate one example of control operation of a signal amplification amount of a direct-sound signal, the control operation being performed by the sound-pressure controller.
Figure 24B:
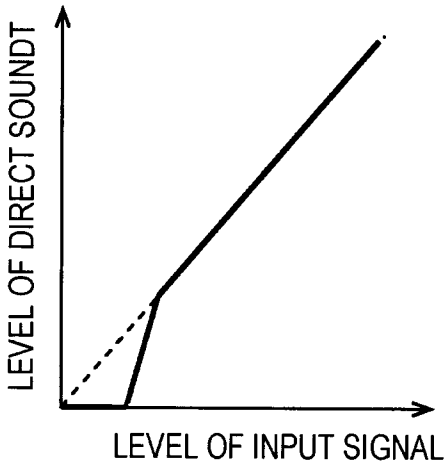
Figure 24C:
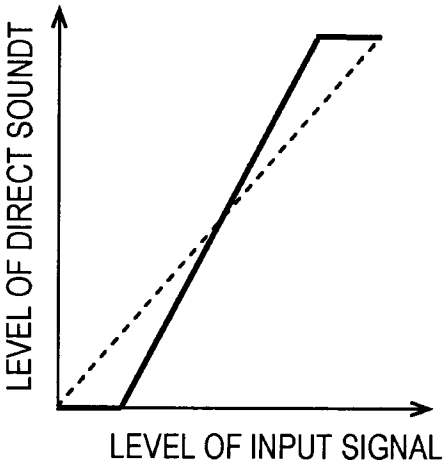

FIGS. 24A to 24C illustrate an example of control operations of the signal amplification amount of a direct-sound signal, the control operation being performed by the sound-pressure controllers 116 and 216. FIG. 24A illustrates an example in which control is performed so that the signal amplification amount increases in only the high level range. FIG. 24B illustrates an example in which control is performed so that the signal amplification amount decreases in only the low level range. FIG. 24C illustrates an example in which the medium level range has no width.

The present disclosure contains subject matter related to that disclosed in Japanese Priority Patent Application JP 2011-044710 filed in the Japan Patent Office on Mar. 2, 2011, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A sound-image control device comprising:

a sound-image controller that processes a left sound signal and a right sound signal to localize a sound image at a predetermined position, wherein the sound-image controller performs control for enhancing a sense of depth to a sound image originally included in an input sound signal, wherein the sound-image controller performs control for enhancing the sense of depth to the sound image originally included in the input sound signal, on a basis of a level of the input sound signal, wherein the sound-image controller includes:

a direct-sound filter that extracts a direct-sound signal from the input sound signal;

an indirect-sound filter that extracts an indirect-sound signal from the input sound signal;

a delay unit that delays the indirect-sound signal extracted by the indirect-sound filter;

a first amplifier that amplifies the direct-sound signal extracted by the direct-sound filter;

a second amplifier that amplifies the indirect-sound signal delayed by the delay unit;

a first sound-pressure controller that controls a signal amplification amount for the first amplifier, in accordance with the level of the input sound signal; and an adder that adds the direct-sound signal amplified by the first amplifier and the indirect-sound signal amplified by the second amplifier to obtain an output sound signal, wherein the sound-image controller further includes a delay controller that controls a signal delay amount for the delay unit in accordance with the level of the input sound signal, and wherein the delay controller reduces at least the signal delay amount for the delay unit in a level range that is higher than a first level of the input sound signal or increases at least the signal delay amount for the delay unit in a level range that is lower than a second level that is lower than the first level of the input sound signal.

2. The sound-image control device according to claim 1, wherein the first sound-pressure controller increases at least the signal amplification amount for the first signal amplifier in a level range that is higher than a first level of the input sound signal or reduces at least the signal amplification amount for the first amplifier in a level range that is lower than a second level that is lower than the first level of the input sound signal.

3. The sound-image control device according to claim 1, wherein the sound-image controller further includes a second sound-pressure controller that controls, in accordance with the level of the input sound signal, the signal amplification amount for the second amplifier so that the signal amplification amount has a reverse characteristic of a characteristic of the signal amplification amount for the first amplifier, the signal amplification amount for the first amplifier controller being controlled by the first sound-pressure controller.

4. The sound-image control device according to claim 1, further comprising a switching operation unit that switches a degree of enhancement of the sense of depth to the sound image originally included in the input sound signal, the enhancement being performed by the sound-image controller.

5. The sound-image control device according to claim 1, wherein the sound-image controller performs control for enhancing the sense of depth to the sound image originally included in the input sound signal, on a basis of the level of the input sound signal and information of parallax between left-eye video and right-eye video included in three-dimensional video corresponding to the input sound signal.

6. The sound-image control device according to claim 5, wherein the first sound-pressure controller increases, by an amount corresponding to a value of the parallax, at least the signal amplification amount for the first signal amplifier in a level range that is higher than a first level of the input sound signal or reduces, by an amount corresponding to the value of the parallax, at least the signal amplification amount for the first amplifier in a level range that is lower than a second level that is lower than the first level of the input sound signal.

7. The sound-image control device according to claim 5, wherein the sound-image controller further includes a second sound-pressure controller that controls, in accordance with the level of the input sound signal and the information of the parallax, the signal amplification amount for the second amplifier so that the signal amplification amount has a reverse characteristic of a characteristic of the signal amplification amount for the first amplifier, the signal amplification amount for the first amplifier being controlled by the first sound-pressure controller.

8. The sound-image control device according to claim 5, wherein the delay controller controls a signal delay amount for the delay unit in accordance with the level of the input sound signal and the information of the parallax.

9. The sound-image control device according to claim 1, further comprising a crosstalk cancellation corrector at an output side of the sound-image controller.

10. A sound-image control device comprising:

a sound-image controller that processes a left sound signal and a right sound signal to localize a sound image at a predetermined position, wherein the sound-image controller performs control for enhancing a sense of depth to a sound image originally included in an input sound signal, a switching operation unit that switches a degree of enhancement of the sense of depth to the sound image originally included in the input sound signal, the enhancement being performed by the sound-image controller, wherein the sound-image controller includes:

a direct-sound filter that extracts a direct-sound signal from the input sound signal;

an indirect-sound filter that extracts an indirect-sound signal from the input sound signal;

a delay unit that delays the indirect-sound signal extracted by the indirect-sound filter;

a first amplifier that amplifies the direct-sound signal extracted by the direct-sound filter;

a second amplifier that amplifies the indirect-sound signal delayed by the delay unit;

a first sound-pressure controller that controls a signal amplification amount for the first amplifier, in accordance with the level of the input sound signal;

a second sound-pressure controller that controls, in accordance with the level of the input sound signal, the signal amplification amount for the second amplifier so that the signal amplification amount has a reverse characteristic of a characteristic of the signal amplification amount for the first amplifier, the signal amplification amount for the first amplifier being controlled by the first sound-pressure controller;

a delay controller that controls a signal delay amount for the delay unit in accordance with the level of the input sound signal; and an adder that adds the direct-sound signal amplified by the first amplifier and the indirect-sound signal amplified by the second amplifier to obtain an output sound signal, wherein the switching operation unit switches control operations of the first sound-pressure controller, the second sound-pressure controller, and the delay controller.

11. A sound-image control device comprising:

a sound-image controller that processes a left sound signal and a right sound signal to localize a sound image at a predetermined position, wherein the sound-image controller performs control for enhancing a sense of depth to a sound image originally included in an input sound signal, wherein the sound-image controller performs control for enhancing the sense of depth to the sound image originally included in the input sound signal, on a basis of a level of the input sound signal and information of parallax between left-eye video and right-eye video included in three-dimensional video corresponding to the input sound signal, wherein the sound-image controller includes:

a direct-sound filter that extracts a direct-sound signal from the input sound signal;

an indirect-sound filter that extracts an indirect-sound signal from the input sound signal;

a delay unit that delays the indirect-sound signal extracted by the indirect-sound filter;

a first amplifier that amplifies the direct-sound signal extracted by the direct-sound filter;

a second amplifier that amplifies the indirect-sound signal delayed by the delay unit;

a first sound-pressure controller that controls a signal amplification amount for the first amplifier, in accordance with the level of the input sound signal and the information of the parallax; and an adder that adds the direct-sound signal amplified by the first amplifier and the indirect-sound signal amplified by the second amplifier to obtain an output sound signal, wherein the sound-image controller further includes a delay controller that controls a signal delay amount for the delay unit in accordance with the level of the input sound signal and the information of the parallax, wherein the delay controller reduces, by an amount corresponding to a value of the parallax, at least the signal delay amount for the delay unit in a level range that is higher than a first level of the input sound signal or increases, by an amount corresponding to the value of the parallax, at least the signal delay amount for the delay unit in a level range that is lower than a second level that is lower than the first level of the input sound signal.

12. A sound-image control method for processing a left sound signal and a right sound signal to localize a sound image at a predetermined position, the method comprising:

controlling a sense of depth to a sound image originally included in an input sound signal, in accordance with a level of the input sound signal, enhancing the sense of depth to the sound image originally included in the input sound signal, on a basis of a level of the input sound signal, extracting a direct-sound signal from the input sound signal;

extracting an indirect-sound signal from the input sound signal;

delaying the indirect-sound signal extracted by the indirect-sound filter;

amplifying the direct-sound signal extracted by the direct-sound filter;

amplifying the indirect-sound signal delayed by the delay unit;

controlling a signal delay amount for the first amplifier, in accordance with the level of the input sound signal; and adding the direct-sound signal amplified by the first amplifier and the indirect-sound signal amplified by the second amplifier to obtain an output sound signal, controlling a signal delay amount for the delay unit in accordance with the level of the input sound signal, and reducing at least the signal delay amount for the delay unit in a level range that is higher than a first level of the input sound signal or increases at least the signal delay amount for the delay unit in a level range that is lower than a second level that is lower than the first level of the input sound signal.

* * * * *